US005914299A

United States Patent [19]

Harmer et al.

[11] Patent Number: 5,914,299

[45] Date of Patent: Jun. 22, 1999

[54] ABRASIVE ARTICLES INCLUDING A POLYMERIC ADDITIVE

[75] Inventors: Walter L. Harmer, Arden Hills; James P. DiZio, St. Paul; Alan R. Kirk, Cottage Grove, all of Minn.

[73] Assignee: Minnesota Mining and Manufacturing Company, St. Paul, Minn.

[21] Appl. No.: 08/933,392

[22] Filed: Sep. 19, 1997

[51] Int. Cl.[6] ..... S24D 3/34

[52] U.S. Cl. ..... 51/298; 51/295; 51/306; 524/507; 524/539; 524/871

[58] Field of Search ..... 51/293, 298, 306; 524/307, 539, 871

[56] References Cited

U.S. PATENT DOCUMENTS

| | | | |
|---|---|---|---|
| H11678 | 9/1997 | Ronning . | |
| 2,532,011 | 11/1950 | Dahlquist et al. . | |
| 2,607,711 | 8/1952 | Hendricks . | |
| 2,829,073 | 4/1958 | Williams . | |
| 2,876,894 | 3/1959 | Dahlquist et al. . | |
| 2,913,355 | 11/1959 | Collins . | |
| 3,051,588 | 8/1962 | Lavanchy . | |
| 3,052,566 | 9/1962 | Smith . | |
| 3,285,771 | 11/1966 | Dabroski . | |
| 3,342,625 | 9/1967 | Grossman et al. . | |
| 3,475,196 | 10/1969 | Bartell et al. . | |
| 3,502,497 | 3/1970 | Crocker . | |
| 3,510,342 | 5/1970 | Demmig et al. . | |
| 3,928,690 | 12/1975 | Settineri et al. . | |
| 4,622,360 | 11/1986 | Gomi et al. | 524/507 |
| 4,903,440 | 2/1990 | Larson et al. | 51/298 |
| 5,128,412 | 7/1992 | Miyasaka et al. | 525/108 |

FOREIGN PATENT DOCUMENTS

| | | |
|---|---|---|
| 0 086 406 A1 | 8/1983 | European Pat. Off. . |
| 0 303 416 | 2/1989 | European Pat. Off. . |
| 0 409 218 A2 | 1/1991 | European Pat. Off. . |
| 0 448 399 A2 | 9/1991 | European Pat. Off. . |
| 0 484 093 A2 | 5/1992 | European Pat. Off. . |
| 0 606 532 A1 | 7/1994 | European Pat. Off. . |
| 0 620 235 A2 | 10/1994 | European Pat. Off. . |
| 60-090 672 | 5/1985 | Japan . |
| WO 93/11933 | 6/1993 | WIPO . |
| WO 97/31042 | 8/1997 | WIPO . |

*Primary Examiner*—Deborah Jones
*Attorney, Agent, or Firm*—Scott A. Bardell

[57] ABSTRACT

An abrasive article is provided that includes at least one binder system formed from a polymeric additive and a thermosetting resin. The polymeric additive includes a polymeric backbone having substituents attached thereto, wherein the substituents include at least one urethane linked nitrogen bonded side chain having about 5 carbon atoms or more and a terminal methyl group and at least one oxygen linked water solubilizing group. An abrasive article that includes the binder system exhibits an increase of workpiece surface abraded in a Woodsanding Normal Force Test as compared to an abrasive article including a binder system formed from a composition containing substantially no polymeric additive.

46 Claims, 2 Drawing Sheets

ABRASIVE ARTICLES INCLUDING A POLYMERIC ADDITIVE

BACKGROUND OF THE INVENTION

In general, abrasive products are known to have abrasive particles adherently bonded to a sheet-like backing. It is generally known to stratify the abrasive particles and binders, such as in coated abrasive articles, in such a way as to basically segregate the abrasive particles between an underlying binder and an overlaying binder.

More typically, abrasive products have a backing substrate, abrasive particles, and a binder which operates to bond or hold the abrasive particles to the backing. For example, a typical coated abrasive product has a backing that is first coated with a binder, commonly referred to as a "make coat," and then the abrasive particles are applied to the make coat. The application of the abrasive particles to the make coat typically involves electrostatic deposition or a mechanical process which maximizes the probability that the individual abrasive particles are positioned with their major axis oriented perpendicular to the backing surface. As so applied, the abrasive particles optimally are at least partially embedded in the make coat that is then generally solidified or set (such as by a series of drying or curing ovens) to a state sufficient to retain the adhesion of abrasive particles to the backing.

Optionally, after precuring or setting the make coat, a second binder, commonly referred to as a "size coat," can be applied over the surface of the make coat and abrasive particles, and, upon setting, it further supports the particles and enhances the anchorage of the particles to the backing. Further, a "supersize" coat, which may contain grinding aids, anti-loading materials or other additives can be applied over the cured size coat. In any event, once the size coat and supersize coat, if used, has been cured, the resulting coated abrasive product can be converted into a variety of convenient forms such as sheets, rolls, belts, and discs.

Coated abrasives are used to abrade a variety of workpieces including metal, metal alloys, glass, wood, paint, plastics, etc. In abrading certain workpieces, for example, wood, paint, and plastics, the coated abrasive has a tendency to "load." "Load" or "loading" are terms used in the industry to describe the debris, or swarf, that is abraded away from the workpiece surface that subsequently becomes lodged between the abrasive particles of the abrasive article. Loading is generally undesirable because the debris lodged between abrasive particles inhibits the cutting ability of the abrasive article.

On solution to the loading problem is to apply a supersize coating over the size coating. For example, U.S. Pat. No. 2,768,886 (Twombly), describes a metal stearate supersize coating that may reduce the amount of loading. Metal stearate supersize coatings have been employed in coated abrasive articles that are designed to abrade paint and lacquer type coatings. However, metal stearate supersize coatings may not be effective in some abrading operations. For example, wood and wood-like materials (such as particle board and pressboard) are in some instances abraded with coated abrasive belts. These coated abrasive belts typically operate at higher abrading speeds and pressures than coated abrasive discs or sheets. As a result, a metal stearate supersize is worn away from the coated abrasive belt in a relatively short period of time. The end result is that the metal stearate supersize may be effective at reducing loading in a coated abrasive belt, but the supersize life is essentially so short so as to be ineffective.

Loading is a serious problem in the area of wood sanding. In many applications, coated abrasive articles tend to load with the sawdust that is abraded away from the wood or wood-like surface. This loading typically leads to burning of the sawdust at the interface between the surface of the abrasive article and the surface of the wood workpiece adjacent to the abrasive article. If sawdust burning does occur, this can lead to damage to the underlying wood workpiece. Additionally, loading reduces the effective work life of the coated abrasive article.

SUMMARY OF THE INVENTION

In the abrasives industry, a load resistant coating for abrasive articles that can be used under relatively high abrading pressures and relatively high abrading speeds is desirable. Accordingly, one aspect of the present invention is an abrasive article including a backing having a first major surface and a second major surface; a plurality of abrasive particles; and at least one binder system formed from a composition including a thermosetting resin and a polymeric additive. A polymeric additive includes a polymeric backbone component having substituents attached thereto, wherein the substituents include at least one urethane linked nitrogen-bonded hydrocarbon side chain having about 5 carbon atoms or more in length and a terminal methyl group; and at least one oxygen linked water solubilizing group, wherein the binder system adheres the plurality of abrasive particles to the first major surface of the backing.

The substituents may further include hydrogen; a hydroxyl group; a halide; an alkyl group;

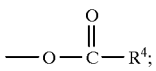

$$-O-\overset{\overset{\displaystyle O}{\|}}{C}-R^4;$$

$-O-R^5$; $-R^6$; and mixtures thereof, wherein each $R^4$, $R^5$, and $R^6$ are independently selected from the group of an aliphatic, an aromatic group, and mixtures thereof.

In accordance with the present invention, a polymeric additive includes a polymer with a water solubilizing group that is capable of being ionized or is the ionized form thereof, that may either be anionic or cationic. In one embodiment, the water solubilizing group comprises an acidic group capable of forming an anionic species. In another embodiment, the water solubilizing group includes an anionic group comprising an anion selected from the group of $-OSO_2O^-$, $-SO_2O^-$, $-CO_2^-$, $(-O)_2P(O)O^-$, $-OP(O)(O^-)_2$, $-P(O)(O^-)_2$, $-P(O^-)_2$, $-PO(O^-)_2$,$^-$. In yet another embodiment, the water solubilizing group includes a cation selected from the group of $-NH(R^8)_2^+$ or $-N(R^8)_3^+$, wherein each $R^8$ is independently selected from the group of a phenyl group; a cycloaliphatic group; and a straight or branched aliphatic group having about 1 to about 12 carbon atoms.

In another aspect of the present invention, the plurality of abrasive particles and the at least one binder system together form a plurality of precisely shaped composites on the first major surface of the backing.

Preferred thermosetting resins that may be included in the at least one binder system are selected from the group of a phenolic resin, an aminoplast resin having pendant α,β-unsaturated carbonyl groups, a urethane resin, an epoxy resin, a urea-formaldehyde resin, and mixtures thereof More preferably, the thermosetting resin is a phenolic resin. Additionally, the at least one binder system is formed from a composition that further includes an optional additive selected from the group of a filler, a fiber-containing material, an antistatic agent, a lubricant, a wetting agent, a surfactant, a pigment, a dye, a coupling agent, a plasticizer, a release agent, a suspending agent, a curing agent, and a compatible mixture thereof.

Also provided in the present invention is an abrasive article including a backing having a first major surface and a second major surface; a plurality of abrasive particles; a make coat binder system formed from a binder precursor, wherein the make coat binder system bonds the plurality of abrasive particles to the first major surface of the backing; and a size coat binder system. Preferably, the size coat binder system is formed from a composition including formed a thermosetting resin and a polymeric additive comprising a polymeric backbone component having substituents attached thereto, wherein the substituents include at least one urethane linked nitrogen-bonded hydrocarbon side chain having about 5 carbon atoms or more in length and a terminal methyl group; and at least one oxygen linked water solubilizing group. The size coat binder system forms at least a portion of a peripheral surface of the abrasive article.

"Peripheral surface," as used herein, refers to a portion of the bond system that is present over and in between at least a portion of the plurality of abrasive particles and is capable of contacting and abrading the surface of the workpiece by an abrasive article.

An abrasive article in accordance with the present invention exhibits an increase in total cut in a Woodsanding Normal Force Test (as described herein) as compared to an abrasive article including a size coat binder system formed from a composition containing substantially no polymeric additive.

In a further aspect of the present invention, an abrasive article is provided that includes a backing having a first major surface and a second major surface; a plurality of abrasive particles; a make coat binder system formed from a first binder precursor, wherein the make coat binder system bonds the plurality of abrasive particles to the first major surface of the backing; and a size coat binder system. Preferably, the size coat binder system is formed from a composition including a thermosetting resin and a polymeric additive comprising:

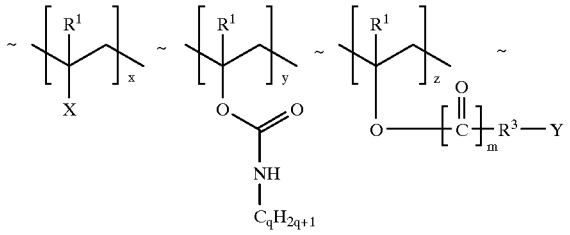

wherein each $R^1$ is independently selected from the group of hydrogen and an aliphatic group, each X is independently selected from the group of hydrogen; a hydroxyl group; a halide; an alkylene, an alkenylene, an arylene group, or mixtures thereof, having a terminal hydroxyl group;

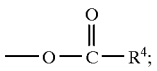

—O—$R^5$; and —$R^6$, wherein each $R^4$, $R^5$ and $R^6$ are independently selected from the group of an aliphatic group, an aromatic group, and mixtures thereof, and wherein each $R^3$ is independently a divalent organic linking group; m is 0 or 1; and each Y is independently a functionality capable of being ionized or is the ionized form thereof, and further wherein x is about 0 to about 70; y is about 5 to about 95; and z is about 5 to about 50. A water solubilizing group includes those moieties described above. Optionally, the abrasive article may further include a peripheral coating formed from another binder precursor, wherein the peripheral coating is formed on the size coat binder system, thus yielding a super size coat.

In a further aspect of the present invention, an abrasive article includes a backing having a first major surface and a second major surface; a plurality of abrasive particles; a make coat binder system formed from a first binder precursor, wherein the make coat binder system bonds the plurality of abrasive particles to the first major surface of the backing; and a peripheral coat binder system wherein the peripheral coat is present over the size coat. Preferably, the peripheral coat binder system is formed from a composition including a thermosetting resin; and a polymeric additive including repeat units of the following formula:

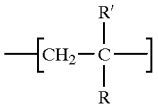

wherein each $R^1$ is independently selected from the group of hydrogen and an aliphatic group (preferably having 1 to 4 carbon atoms); and each R is independently selected from the group of X; a urethane-linked hydrocarbon:

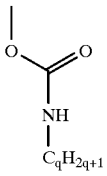

wherein q is 5 or more; and an oxygen linked water solubilizing group:

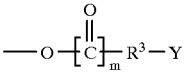

wherein each X moiety is independently selected from the group of hydrogen; a hydroxyl group; a halide; an alkylene, an alkenylene, an arylene group, or mixtures thereof, having a terminal hydroxyl group;

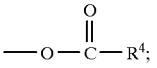

—O—$R^5$; or —$R^6$, wherein each $R^4$, $R^5$, and $R^6$ are independently selected from the group of an aliphatic group, an aromatic group, and mixtures thereof, and further wherein each $R^3$ is independently a divalent organic linking group; m is 0 or 1; and each Y moiety is independently a functionality capable of being ionized or is the ionized form thereof, as described above.

Another aspect of the present invention provides an abrasive article including a backing having a first major surface and a second major surface; a plurality of abrasive particles; and at least one binder system formed from a composition comprising a thermosetting resin and a polymeric additive. A polymeric additive preferably includes an ethylene-containing backbone having substituents attached thereto, wherein the substituents include at least one urethane linked nitrogen-bonded hydrocarbon side chain having about 5 carbon atoms or more in length and a terminal methyl group; and at least one oxygen linked water solubilizing group. Preferably, the binder system adheres the plurality of abrasive particles to the first major surface of the backing. In this embodiment, the peripheral coating is selected from the group of a size coat and a supersize coat. Optionally, the peripheral coat binder system is formed from a composition that further includes an optional additive selected from the group of a filler, a fiber-containing material, an antistatic agent, a lubricant, a wetting agent, a surfactant, a pigment, a dye, a coupling agent, a plasticizer, a release agent, a suspending agent, a curing agent, and a compatible mixture thereof.

Yet another aspect of the present invention is an abrasive article that includes a backing having a first major surface and a second major surface; a plurality of abrasive particles; and at least one binder system formed from a composition including a polymeric additive comprising a polymeric backbone component having substituents attached thereto. Preferably, the substituents include at least one urethane linked nitrogen-bonded hydrocarbon side chain having about 5 carbon atoms or more in length and a terminal methyl group; and at least one oxygen linked water solubilizing group, wherein the binder system adheres the plurality of abrasive particles to the first major surface of the backing. Preferably, the substituents may further include hydrogen; a hydroxyl group; a halide; an alkyl group;

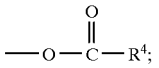

—O—$R^5$; —$R^6$; and mixtures thereof, wherein each $R^4$, $R^5$, and $R^6$ are independently selected from the group of an aliphatic, an aromatic group, and mixtures thereof.

Also provided in the present invention is a method for making a coated abrasive article. Preferably, the method includes the steps of applying a first binder precursor to a substrate; at least partially embedding a plurality of abrasive particles in the first binder precursor; at least partially curing the first binder precursor; applying a composition formed by blending a thermosetting resin and a polymeric additive over the at least partially cured first binder precursor and the plurality of abrasive particles; and curing the thermosetting resin. Preferably, the polymeric additive comprises an ethylene-containing backbone having at least one pendant urethane linked nitrogen-bonded hydrocarbon side chain having about 5 carbon atoms or more in length and a terminal methyl group; and at least one pendant oxygen linked water solubilizing group, as stated above. A method may further include the steps of applying an intermediate binder precursor over the at least partially cured first resin precursor and the plurality of abrasive particles; and at least partially curing the intermediate binder precursor prior to applying the composition formed by blending a thermosetting resin and a polymeric additive.

In another aspect of the invention, a method of reducing a surface of a workpiece is also provided. A method preferably includes the steps of frictionally engaging a peripheral surface of an abrasive article with a surface of a workpiece; and moving the abrasive article and the workpiece relative to each other such that the surface of the workpiece is reduced. In one embodiment, an abrasive article includes a backing having a first major surface and a second major surface; a plurality of abrasive particles; at least one binder system formed from a composition including a thermosetting resin and a polymeric additive. A polymeric additive includes a polymeric backbone component having substituents attached thereto, wherein the substituents include at least one urethane linked nitrogen-bonded hydrocarbon side chain having about 5 carbon atoms or more in length and a terminal methyl group; and at least one oxygen linked water solubilizing group, wherein the binder system adheres the plurality of abrasive particles to the first major surface of the backing.

In another embodiment of a method of reducing a surface of a workpiece according to the invention, an abrasive article includes a backing having a first major surface and a second major surface; a plurality of abrasive particles; a make coat binder system formed from a first binder precursor, wherein the make coat binder system bonds the plurality of abrasive particles to the first major surface of the backing; and a size coat binder system present over the abrasive particles on at least a portion of the plurality of the abrasive particles forming at least a portion of the peripheral surface. Preferably, the size coat binder system is formed from a composition including a thermosetting resin and an ethylene-containing backbone having at least one pendant urethane linked nitrogen-bonded hydrocarbon side chain having about 5 carbon atoms or more in length and a terminal methyl group; and at least one pendant oxygen linked water solubilizing group.

In a further embodiment of a method of reducing a surface of a workpiece, an abrasive article includes a backing having a first major surface and a second major surface; a plurality of abrasive particles; a make coat binder system formed from a first binder precursor, wherein the make coat binder system bonds the plurality of abrasive particles to the first major surface of the backing; and a size coat binder system present over the abrasive particles on at least a portion of the plurality of the abrasive particles forming at least a portion of the peripheral surface. Preferably, the size coat binder system is formed from a composition including a thermosetting resin and a polymeric additive comprising an ethylene-containing backbone having substituents attached thereto, wherein the substituents include at least one urethane linked nitrogen-bonded hydrocarbon side chain having about 5 carbon atoms or more in length and a terminal methyl group; and at least one oxygen linked water solubilizing group.

In yet another embodiment of a method of reducing a surface of a workpiece, an abrasive article includes a backing having a first major surface and a second major surface; a plurality of abrasive particles; a make coat binder system formed from a first binder precursor, wherein the make coat binder system bonds the plurality of abrasive particles to the first major surface of the backing; a peripheral coat binder system present over the abrasive particles on at least a portion of the plurality of the abrasive particles forming at least a portion of the peripheral surface. Preferably, the peripheral coat binder system is formed from a composition including a thermosetting resin comprising a phenolic resin; and a polymeric additive comprising a polymeric backbone component having at least one pendent urethane-linked hydrocarbon:

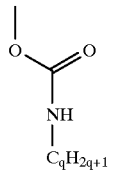

wherein q is 5 or more; and at least one pendant oxygen linked water solubilizing group:

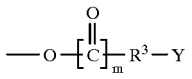

wherein each $R^3$ is independently a divalent organic linking group; m is 0 or 1; and each Y moiety independently comprises a functionality capable of being ionized or is the ionized form thereof.

BRIEF DESCRIPTION OF THE SEVERAL VIEWS OF THE DRAWING

Other features, advantages, and further methods of practicing the invention will be better understood from the following description of figures and the preferred embodiments of the present invention.

DETAILED DESCRIPTION OF PREFERRED EMBODIMENTS

Abrasive Articles

Figure 1:
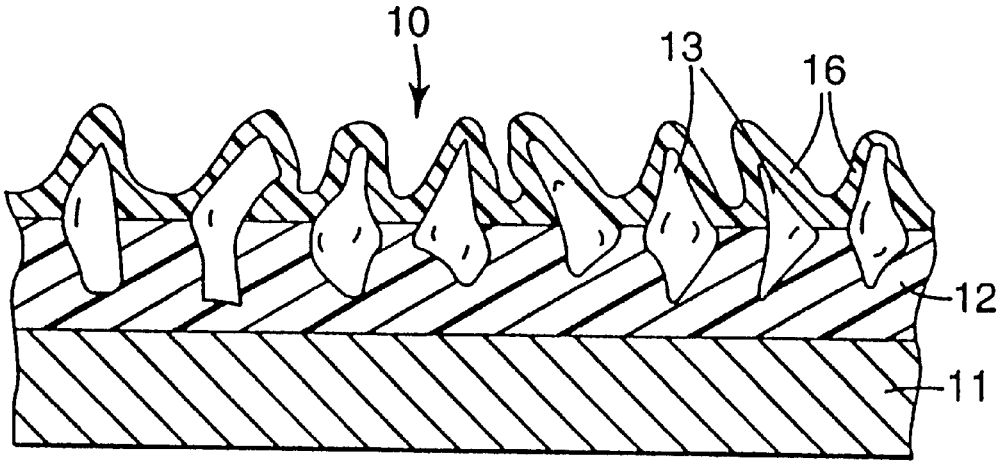
FIG. 1 is an enlarged cross-sectional view of one embodiment of an abrasive article of the present invention.

Abrasive articles in accordance with the invention typically comprise a plurality of abrasive particles and at least one binder system formed from a composition including a polymeric additive and a thermosetting resin. Preferably, the polymeric additive is a polymer having a polymeric backbone with substituents attached thereto, wherein the substituents include at least one urethane linked nitrogen bonded hydrocarbon side chain having about 5 carbon atoms or more and a terminal methyl group and at least one oxygen linked water solubilizing group.

Examples of abrasive articles include coated abrasive articles, lapping abrasive articles, structured abrasive articles, and nonwoven abrasive articles.

Coated Abrasive Articles

Coated abrasive articles of the invention include a backing having a first major surface and a second major surface, a plurality of abrasive particles and at least one binder system formed from a composition comprising a thermosetting resin and a polymeric additive. A polymeric additive included in accordance with the invention includes a polymeric backbone component having substituents attached thereto, wherein the substituents include at least one urethane linked nitrogen-bonded hydrocarbon side chain having about 5 carbon atoms or more in length and a terminal methyl group; and at least one oxygen linked water solubilizing group. The at least one binder system can be included in either a make coat, a size coat, a supersize coat, or all three. For example, if the at least one binder system is included in a make coat, it adheres the plurality of abrasive particles to the first major surface of the backing. Preferably, the at least one binder system is included in the size coat binder system and forms a peripheral coating of the abrasive article.

A backing for a coated abrasive article of the present invention can be any number of various materials conventionally used as backings in the manufacture of coated abrasives, such as paper, cloth, film, polymeric foam, vulcanized fiber, woven and nonwoven materials, and the like, or a combination of two or more of these materials or treated versions thereof. The backing may also be a laminate of paper/film, cloth/paper, film/cloth, and the like. The choice of backing material will depend on the intended application of the abrasive article. The strength of the backing should be sufficient to resist tearing or other damage in use, and the thickness and smoothness of the backing should allow achievement of the product thickness and smoothness desired for the intended application.

One preferred backing suitable for the use in the invention is a cloth backing. The cloth is composed of yarns in the warp direction, i.e., the machine direction and yarns in the fill direction, i.e., the cross direction. The cloth backing can be a woven backing, a stitchbonded backing, or a weft insertion backing. Examples of woven constructions include sateen weaves of 4 over one weave of the warp yarns over the fill yarns; twill weave of 3 over one weave; plain weave of one over one weave; and a drill weave of two over two weave. In a stitchbonded fabric or weft insertion backing, the warp and fill yarns are not interwoven, but are oriented in two distinct directions from one another. The warp yarns are laid on top of the fill yarns and secured to another by a stitch yarn or by an adhesive.

Yarns in the cloth backing may be natural, synthetic or a combination thereof Examples of natural yarns include cellulosic materials such as cotton, hemp, kapok, flax, sisal, jute, carbon, manilla and a combination thereof. Examples of synthetic yarns include polyester yarns, polypropylene yarns, glass yarns, polyvinyl alcohol yarns, aramid yarns, polyimide yarns, rayon yarns, nylon yarns, polyethylene yarns and a combination thereof.

The backing in a coated abrasive article may have an optional saturant coat, a presize coat and/or a backsize coat. The purpose of these coats is to seal the backing and/or protect the yarn or fibers in the backing. If the backing is a cloth material, at least one of these coats may be required. The addition of the presize coat or backsize coat may additionally result in a "smoother" surface on either the front and/or the back side of the backing.

Additionally, an antistatic material may be included in any of these cloth treatment coats. The addition of an antistatic material can reduce the tendency of the coated abrasive article to accumulate static electricity when sanding wood or wood-like materials. Additional details concerning antistatic backings and backing coats (treatments) can be found in, for example, U.S. Pat. Nos. 5,108,463; 5,137,542; 5,328,716; and 5,560,753.

The backing may also be a fibrous reinforced thermoplastic, for example, as disclosed in U.S. Pat. No. 5,417,726 (Stout), or an endless spliceless belt, for example, as disclosed in WO 93/12911 (Benedict et al.). Likewise, the backing may be a polymeric substrate having hooking stems projecting therefrom, for example, as disclosed in WO 95/19242 (Chesley et al.). Similarly, the backing may be a loop fabric, for example, as described in U.S. Pat. No. 5,565,011 (Follett et al.).

Figure 2:
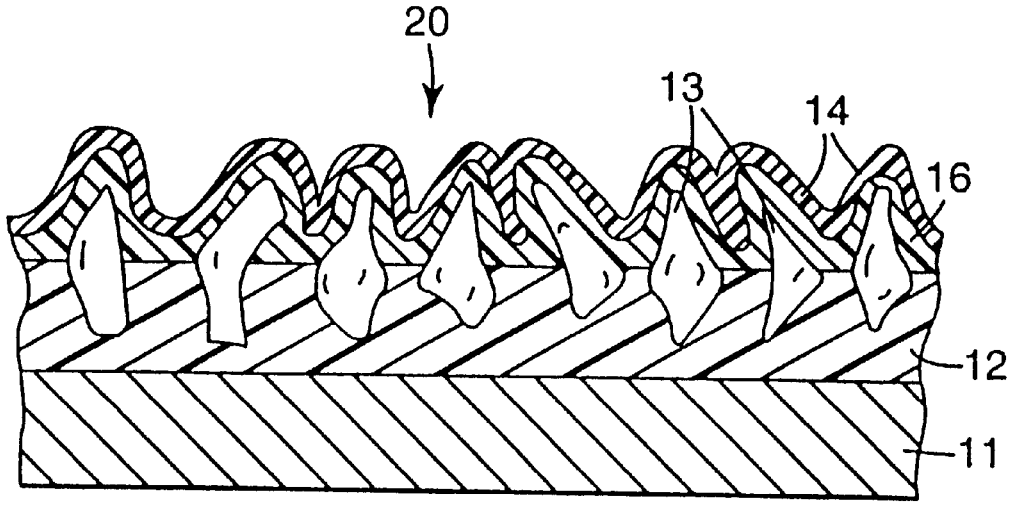
FIG. 2 is an enlarged cross-sectional view of another embodiment of an abrasive article of the present invention.

With reference to FIG. 1, one embodiment of a coated abrasive article 10 of the present invention may include a first binder system 12 (commonly referred to as a make coat) bonded to one side (a major surface) of the backing 11, a plurality of abrasive particles 13 bonded to the backing by the make coat 12, and a size coat binder system 16 formed from a composition including a thermosetting resin and a polymeric additive. Preferably, the size coat binder system 16 is formed on and in between the plurality of abrasive particles, thus forming a peripheral coating on the abrasive article. With reference to FIG. 2, a coated abrasive article 20 of the present invention may include a make coat binder system 12, a backing 11, a plurality of abrasive particles 13, and a size coat binder system 16, as described with respect to FIG. 1, and a supersize coat binder system 14 including a thermosetting resin and a polymeric additive over at least a portion of the size coat binder system 16.

Coated abrasives of the present invention also include lapping abrasive articles and structured coated abrasive articles. A lapping coated abrasive article comprises a backing having an abrasive coating bonded to the backing. The abrasive coating comprises a plurality of abrasive particles distributed in a binder. In some instances, the binder bonds this abrasive coating to the backing. Alternatively, an additional material may be used to bond the abrasive coating to the backing, which may be selected, for example, from the binder precursors described herein and may be the same or different than the binder precursor used to form the abrasive coating. Generally, the particle size of the abrasive particles used in a lapping coated abrasive ranges, on average, from about 0.01 to less than about 200 micrometers, typically, 0.1 to 120 micrometers. The abrasive coating may have a smooth outer surface or a textured outer surface. The abrasive coating may also further comprise additives as discussed herein.

Figure 3:
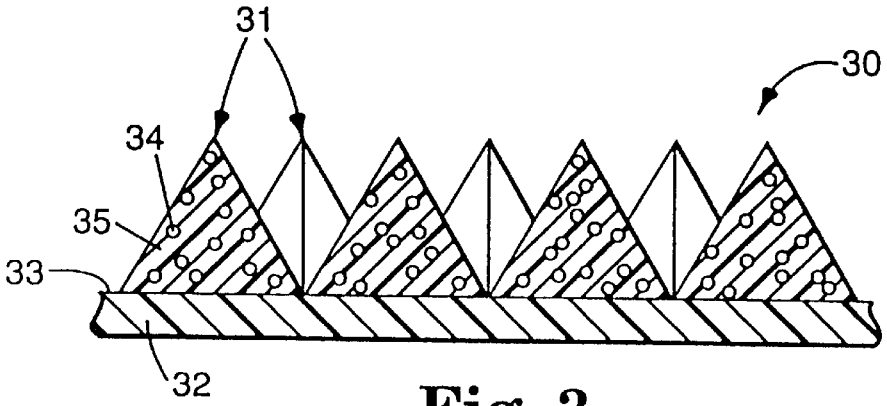
FIG. 3 is an enlarged cross-sectional view of an alternate embodiment of an abrasive article of the present invention.
Figure 4:
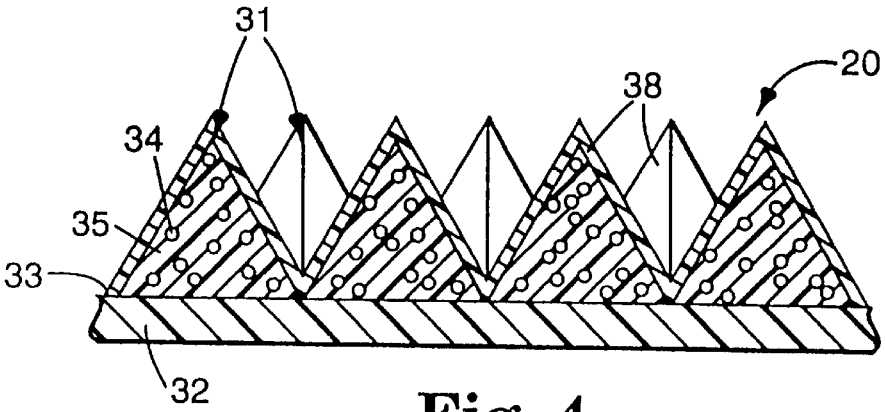
FIG. 4 is an enlarged cross-sectional view of a further embodiment of an abrasive article of the present invention.

With reference to FIG. 3, a structured abrasive article 30 comprises a backing 32 having a plurality of precisely shaped abrasive composites 31 bonded to a major surface 33 of the backing 32. In some instances, a binder system 35 bonds the abrasive composites to the backing, wherein the binder system is formed from a composition including a thermosetting resin and a polymeric additive. Alternatively, an additional material may be used to bond the abrasive composite to the backing, which may be selected, for example, from the binder precursors described herein and may be the same or different than the binder precursors used to form the abrasive composite. With reference to FIG. 4, a structured abrasive may comprise, in addition to a backing 32 having a major surface 33, and a plurality of abrasive composites 31 comprising a binder 35 and a plurality of abrasive particles 34, a peripheral coating 38 over at least a portion of the plurality of abrasive composites 31. Binder 35 and/or peripheral coating 38 may contain a polymeric additive, as described herein.

In some instances, it may be preferred to incorporate a pressure sensitive adhesive onto the back side of the coated abrasive such that the resulting coated abrasive can be secured to a back up pad. Representative examples of pressure sensitive adhesives suitable for this invention include latex crepe, rosin, acrylic polymers and copolymers e.g., polybutylacrylate, polyacrylate ester, vinyl ethers, e.g., polyvinyl n-butyl ether, alkyd adhesives, rubber adhesives, e.g., natural rubber, synthetic rubber, chlorinated rubber, and mixtures thereof. A preferred pressure sensitive adhesive is an isooctylacrylate:acrylic acid copolymer. The coated abrasive can be in the form of a roll of abrasive discs, as described in U.S. Pat. No. 3,849,949 (Steinhauser et al.).

Alternatively, the coated abrasive may contain a hook and loop type attachment system to secure the coated abrasive to the back up pad. The loop fabric may be on the back side of the coated abrasive with hooks on the back up pad. Alternatively, the hooks may be on the back side of the coated abrasive with the loops on the back up pad.

A hook and loop type attachment system is further described in U.S. Pat. Nos. 4,609,581 and 5,254,194 and International Publication No. WO 95/19242. Alternatively, the make coat precursor may be coated directly onto the loop fabric, for example, as disclosed in U.S. Pat. No. 5,565,011 (Follett et al.). In this arrangement, the loop fabric can releasably engage with hooking stems present on a support pad. The make coat precursor may also be coated directly on a hooking stem substrate, which generally comprises a substrate having a front and back surface. The make coat precursor can then be applied to the front surface of the substrate, the hooking stems protruding from the back surface. In this arrangement, the hooking stems can releasably engage with a loop fabric present on a support pad.

The coated abrasive may be converted into a variety of different shapes and forms such as belts, discs, sheets, tapes, daisies and the like. The belts may contain a splice or a joint, alternatively the belts may be spliceless such as that taught in International Publication No. WO 93/12911 (Benedict et al.). The belt width may range from about 0.5 cm to 250 cm, typically anywhere from about 1 cm to 150 cm. The belt length may range from about 5 cm to 1000 cm, typically 10 cm to 500 cm. The belt may have straight or scalloped edges. The discs may contain a center hole or have no center hole. The discs may have the following shapes: round, oval, octagon, pentagon, hexagon or the like; all of these converted forms are well known in the art. The discs may also contain dust holes, typically for use with a tool containing a vacuum source. The diameter of the disc may range from about 0.1 cm to 1500 cm, typically from 1 cm to 100 cm. The sheets may be square, triangular, or rectangular. The width ranges from about 1 cm to 100 cm, typically 10 cm to 50 cm. The length ranges from about 1 cm to 1000 cm, typically 10 cm to 100 cm.

It is also feasible to adhere the abrasive particles to both a major or working surface and the opposite surface of a backing. The abrasive particles can be the same or different from one another. In this aspect, the abrasive article is essentially two sided; one side can contain a plurality of abrasive particles which are different from a plurality of abrasive particles on the other side. Alternatively, one side can contain a plurality of abrasive particles having a different particle size than those on the other side. In some instances, this two sided abrasive article can be used in a manner in which both sides of the abrasive article abrade at the same time. For example, in a small area such as a corner, one side of the abrasive article can abrade the top workpiece surface, while the other side can abrade the bottom workpiece surface.

Nonwoven Abrasive Articles

Figure 5:
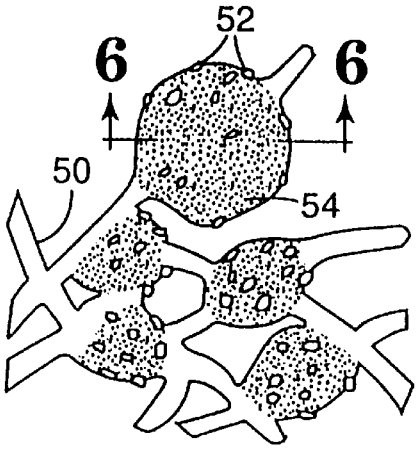
FIG. 5 is an enlarged cross-sectional view of yet another embodiment of an abrasive article of the present invention.
Figure 6A:
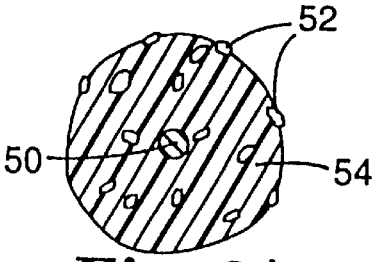
FIG. 6A and 6B illustrate a view taken along line 6—6 of FIG. 5 of one embodiment of an abrasive article of the present invention.
Figure 6B:
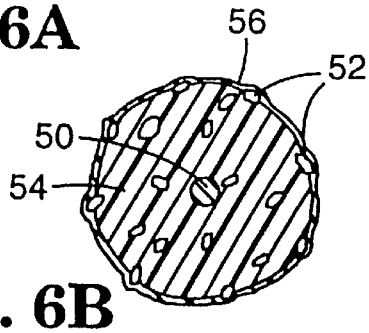

Nonwoven abrasive articles are also within the scope of the invention and include an open, lofty fibrous substrate having a binder which binds fibers at points where they contact. Optionally, abrasive particles or nonabrasive particles (such as fillers) may be adhered to the fibers by the binder if the manufacturer desires. For example, with reference to FIG. 5, a nonwoven abrasive comprises an open, lofty, fibrous substrate comprising fibers 50 and a binder system 54 which binds a plurality of abrasive particles 52 to the fibers. FIG. 6A illustrates a view, along line 6—6 in FIG. 5, of a binder system 54 and abrasive particles 52. In the embodiment represented by FIG. 6A, the binder system 54 is formed from a composition including a thermosetting resin and a polymeric additive. FIG. 6B illustrates another embodiment of the present invention wherein a peripheral coating 56 is coated over at least a portion of the binder system 54 and abrasive particles 52 and/or the binder system 54 may be formed from a composition including a thermosetting resin and a polymeric additive.

Nonwoven abrasives are described generally in U.S. Pat. No. 2,958,593 (Hoover et al.) and U.S. Pat. No. 4,991,362 (Heyer et al.). In the present invention, an antiloading component is present in a part of the abrasive article which will ultimately contact a workpiece during abrading, for example, in a peripheral portion of the nonwoven abrasive article, for example, in a binder or in a peripheral coating over at least a portion of the binder.

Bonded Abrasives

Bonded abrasive products include a shaped mass of abrasive particles held together by an organic, metallic, or vitrified binder. Such shaped mass can be, for example, in the form of a wheel, such as a grinding wheel, cutoff wheel, and the like. It can also be in the form, for example, of a honing stone or other conventional bonded abrasive shape. Such bonded abrasive articles are described generally, for example, in U.S. Pat. No. 4,997,461 (Markhoff-Matheny et al.).

Binders

Binders suitable for an abrasive article of the present invention are formed from a binder precursor. The binder precursor of the present invention may be a water-soluble binder precursor or water-dispersible binder precursor. A binder in accordance with the present invention comprises a cured or solidified binder precursor and serves to adhere a plurality of abrasive particles to a substrate (i.e., a backing for a coated abrasive or a nonwoven for a nonwoven abrasive). The binder included in the make coat, size coat and the supersize coat may be formed from the same binder precursor or each may be formed from a different binder precursor.

The term "binder precursor" as used herein refers to an uncured or a flowable material. The binder precursor is preferably a thermosetting resin. A thermosetting resin, as described herein, is also suitable for combination with a polymeric additive for use in an abrasive article according to the present inveniton. More preferably, the binder precursor is selected from the group of a phenolic resin, an aminoplast resin having pendant α,β-unsaturated carbonyl groups, a urethane resin, an epoxy resin, a urea-formaldehyde resin, an isocyanurate resin, a melamine-formaldehyde resin, an acrylate resin, an acrylated isocyanurate resin, an acrylated urethane resin, an acrylated epoxy resin, a bismaleimide resin, and a mixture thereof.

Phenolic resins are commonly used as an abrasive article binder precursor because of their thermal properties, availability, cost and ease of handling. There are two types of phenolic resins, resole and novolac. Resole phenolic resins have a molar ratio of formaldehyde to phenol of greater than or equal to one to one, typically between 1.5:1.0 to 3.0:1.0. Novolac resins have a molar ratio of formaldehyde to phenol of less than one to one.

Typical resole phenolic resins contain a base catalyst. The presence of a basic catalyst speeds up the reaction or polymerization rate of the phenolic resin. The pH of the phenolic resin is preferably from about 6 to about 12, more preferably from about 7 to about 10 and most preferably from about 7 to about 9. Examples of suitable basic catalysts include sodium hydroxide, potassium hydroxide, calcium hydroxide, magnesium hydroxide, barium hydroxide and a combination thereof Typical catalysts for the reaction of formaldehyde with phenol are chosen from group I and II metal salts, generally because of their high reactivity and low cost. Amines are also used to catalyze the phenol/aldehyde reaction. The preferred basic catalyst is sodium hydroxide. The amount of basic catalyst is preferably about 5% by weight or less, more preferably about 2% by weight or less, even more preferably about 1% by weight or less and most preferably from about 0.5% by weight to about 0.9% by weight of the phenolic resin.

Resole phenolic resins usually are made from phenol and formaldehyde. A portion of the phenol can be substituted with other phenols such as resorcinol, m-cresol, 3,5-xylenol, t-butylphenol and p-phenylphenol. Likewise a portion of the formaldehyde can be substituted with other aldehyde groups such as acetaldehyde, chloral, butylaldehyde, furfural or acrolein. The general term "phenolic" includes phenol-formaldehyde resins as well as resins comprising other phenol-derived compounds and aldehydes. Phenol and formaldehyde are the most preferred constituents in the phenolic resin due to their high reactivity, limited number of side chain reactions and low cost. Resole phenolic and urea-aldehyde resins are preferably about 30% to about 95% solids, more preferably about 60% to about 80% solids, have a viscosity ranging from about 750 cps to about 1500 cps (Brookfield viscometer, number 2 spindle, 60 rpm, 25° C.) before addition of any diluent, and have molecular weight (number average) of about 200 or greater, preferably varying from about 200 to about 700.

The phenolic resin preferably includes about 70% to about 85% solids, and more preferably about 72% to about 82% solids. If the percent solids is very low, then more energy is required to remove the water and/or solvent. If the percent solids is very high, then the viscosity of the resulting phenolic resin is too high which leads to processing problems. The remainder of the phenolic resin can be water and/or an organic solvent. More preferably, the remainder of the phenolic resin is water with substantially no organic solvent due to environmental concerns with both the manufacturing of phenolic resins and abrasive articles.

Examples of commercially available phenolic resins include those known under the trade designations "Varcum" and "Durez" from Occidental Chemical Corp., Tonawanda, N.Y., "Arofene" and "Arotap" from Ashland Chemical Company, Columbus, Ohio; and "Bakelite" from Union Carbide, Danbury, Conn.

It is also within the scope of the present invention to modify the physical properties of a phenolic resin. For example, a plasticizer, latex resin, or reactive diluent may be added to a phenolic resin to modify flexibility and/or hardness of the cured phenolic binder.

A suitable aminoplast resin for use in a binder precursor is one having at least one pendant α,β-unsaturated carbonyl groups per molecule. These unsaturated carbonyl groups can be acrylate, methacrylate or acrylamide type groups. Examples of such materials include N-hydroxymethylacrylamide, N,N'-oxydimethylenebisacrylamide, ortho and para acrylamidomethylated phenol, acrylamidomethylated phenolic novolac and combinations thereof.

Suitable polyurethanes for a binder precursor may be prepared by reacting near stoichiometric amounts of polyisocyanates with polyfunctional polyols. The more common types of polyisocyanates are toluene diisocyanate (TDI) and 4,4'-diisocyanatodiphenylmethane (MDI) which are available under the trade designations "Isonate" from Upjohn Polymer Chemicals, Kalamazoo, Mich. and "Mondur" from Miles, Inc., Pittsburgh, Pa. Common polyols for flexible polyurethanes are polyethers such as polyethylene glycols, which are available under the trade designations "Carbowax" from Union Carbide, Danbury, Conn.; "Voranol" from Dow Chemical Co., Midland, Mich.; and "Pluracol E" from BASF Corp., Mount Olive, N.J.; polypropylene glycols, which are available under the trade designations "Pluracol P" from BASF Corp. and "Voranol" from Dow Chemical Co., Midland, Mich.; and polytetramethylene oxides, which are available under the trade designations "Polymeg" from QO Chemical Inc., Lafayette, Ind.; "Poly THF" from BASF Corp., Mount Olive, N.J.; and "TERATHANE" from DuPont, Wilmington, Del. Hydroxyl functional polyesters are available under the trade designations "Multranol" and "Desmophene" from Miles, Inc., Pittsburgh, Pa.

Epoxy resins utilized in a binder precursor have an oxirane ring and are polymerized by ring opening. Such epoxide resins include monomeric epoxy resins and polymeric epoxy resins. These resins can vary greatly in the nature of their backbones and substituent groups. Examples of epoxy resins include 2,2-bis[4-(2,3-epoxypropoxyphenol)propane (diglycidyl ether of bisphenol A)] and commercially available materials gunder the trade designations, "Epon 828," "Epon 1004," and "Epon 1001F," available from Shell Chemical Co., Houston, Tex.; "DER-331," "DER-332," and "DER-334," all available from Dow Chemical Co., Midland, Mich. Other suitable epoxy resins include glycidyl ethers of phenol formaldehyde novolac (e.g., "DEN-431" and "DEN-438" available from Dow Chemical Co., Midland, Mich.). Other epoxy resins include those described in U.S. Pat. No. 4,751,138 (Tumey et al.).

Urea-aldehyde resins employed in binder precursor compositions comprise urea or any urea derivative and any aldehyde which are capable of being coatable, have the capability of reacting at an accelerated rate in the presence of a catalyst, preferably a cocatalyst, and which afford an abrasive article with abrading performance acceptable for the intended use. The resins comprise the reaction product of an aldehyde and a "urea."

Acrylate resins that can be included in a binder precursor include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Representative examples of acrylate monomers include methyl acrlyate, ethyl acrylate, methyl methacrylate, ethyl methacrylate, ethylene glycol diacrylate, ethylene glycol dimethacrylate, hexanediol diacrylate, triethylene glycol diacrylate, trimethylolpropane triacrylate, glycerol triacrylate, pentaerythritol triacrylate, pentaerythritol trimethacrylate, pentaerythritol tetraacrylate and pentaerythritol tetramethacrylate, as well as these unsaturated monomers, for example, styrene, divinylbenzene, vinyl toluene.

Acrylated isocyanurates useful in a binder precursor are isocyanurate derivatives having at least one pendant acrylate group, which are further described in U.S. Pat. No. 4,652,274 (Boettcher et al.).

Useful acrylated urethanes in a binder precursor are diacrylate esters of hydroxy terminated isocyanate extended polyesters or polyethers. Examples of commercially available acrylated urethanes include those available under the trade designations, "UVITHANE 782," Morton International, Inc., Cincinnati, Ohio "Ebercryl 6600," "Ebercryl 8400," and "Ebercryl 8805," from UCB Radcure, Inc., Atlanta, Ga.

Acrylated epoxies suitable for use in a binder precursor are monoacrylate and diacrylate esters of epoxy resins, such as the diacrylate esters of bisphenol A epoxy resin. Examples of commercially available acrylated epoxies include "Ebercryl 3500," "Ebercryl 3600," and "Ebercryl 3700," available from UCB Radcure, Inc., Atlanta, Ga.

Useful bismaleimide resins are further described in the assignee's U.S. Pat. No. 5,314,513.

In addition to thermosetting resins, a hot melt resin may also be included in a binder precursor. For example, a binder precursor system may comprise a hot melt pressure sensitive adhesive which can be energy cured to provide a binder. In this instance, because the binder precursor is a hot melt composition, it is particularly useful with porous cloth, textile or fabric backings. Since this binder precursor does not penetrate the interstices of the porous backing, the natural flexibility and pliability of the backing is preserved. Exemplary hot melt resins are described in U.S. Pat. No. 5,436,063 (Follett et al.).

The hot melt binder precursor system may comprise an epoxy-containing material, a polyester component, and an effective amount of an initiator for energy curing the binder. More particularly, the binder precursor can comprise from about 2 to 95 parts of the epoxy-containing material and, correspondingly, from about 98 to 5 parts of the polyester component, as well as the initiator. An optional hydroxyl-containing material having a hydroxyl functionality greater than 1 may also be included.

At Least One Binder System

As mentioned above, an abrasive article in accordance with the invention includes at least one binder system formed from a composition that includes a polymeric additive having a polymeric backbone with substituents attached thereto. The composition may also include a thermosetting resin.

I. Polymeric Additive

A polymeric additive preferably is a polymer including a polymeric backbone component that is preferably ethylene-containing (e.g., vinyl-derived) backbone with substituents attached thereto. The polymer comprises repeat units of the following formula:

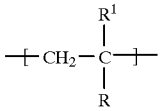

wherein in the polymer each $R^1$ is independently selected from the group of hydrogen and an aliphatic group (preferably having 1 to 4 carbon atoms); and wherein each R is independently selected from the group of X, which can be hydrogen, a halide, or an organic group optionally containing heteroatoms or functional groups; a urethane linked nitrogen bonded hydrocarbon group, such as that shown by the following structure:

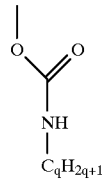

wherein q is about 5 or more; and an oxygen linked water solubilizing group, such as that shown by the following structure:

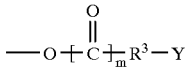

wherein each $R^3$ is independently a divalent organic linking group optionally containing heteroatoms or functional groups (preferably having 1 to 20 carbon atoms), m is 0 or 1, and each Y is independently a functionality capable of being ionized or is the ionized form thereof, with the proviso that the polymer contains at least one each of the urethane linked nitrogen bonded hydrocarbon group and the oxygen bonded water solubilizing group.

As used herein, the terms "organic group" and "organic linking group" means a hydrocarbon group that is classified as an aliphatic group, cyclic group, or combination of aliphatic and cyclic groups (e.g., alkaryl and aralkyl groups). In the context of the present invention, the term "aliphatic group" means a saturated or unsaturated linear or branched hydrocarbon group. This term is used to encompass alkyl, alkenyl, and alkynyl groups, for example. The term "alkyl group" means a saturated linear or branched hydrocarbon group including, for example, methyl, ethyl, isopropyl, t-butyl, heptyl, dodecyl, octadecyl, amyl, 2-ethylhexyl, and the like. The term "alkenyl group" means an unsaturated, linear or branched hydrocarbon group with one or more carbon—carbon double bonds, such as a vinyl group. The term "alkynyl group" means an unsaturated, linear or branched hydrocarbon group with one or more carbon—carbon triple bonds. The term "cyclic group" means a closed ring hydrocarbon group that is classified as an alicyclic group, aromatic group, or heterocyclic group. The term "alicyclic group" means a cyclic hydrocarbon group having properties resembling those of aliphatic groups. The term "aromatic group" or "aryl group" means a mono- or polynuclear aromatic hydrocarbon group. Such organic groups or organic linking groups, as used herein, include heteroatoms (e.g., O, N, or S atoms), as well as functional groups (e.g., carbonyl groups).

Preferably, each X moiety is independently selected from the group of hydrogen; a hydroxyl group; a halide; an alkylene, an alkenylene, an alkynylene, an arylene group, or mixture thereof, having a terminal hydroxyl group (preferably having 1 to 10 carbon atoms);

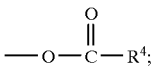

—O—$R^5$; and —$R^6$; wherein each $R^4$, $R^5$, and $R^6$ is independently selected from the group of an aliphatic group, an aromatic group, and mixtures thereof, optionally containing heteroatoms or functional groups. Preferably, each $R^4$, $R^5$, and $R^6$ independently has 1 to 20 carbon atoms.

Because each Y moiety is independently a functionality capable of being ionized or is the ionized form thereof, the polymer is capable of being dissolved or dispersed in water. Accordingly, a polymer of the present invention preferably contains the following units:

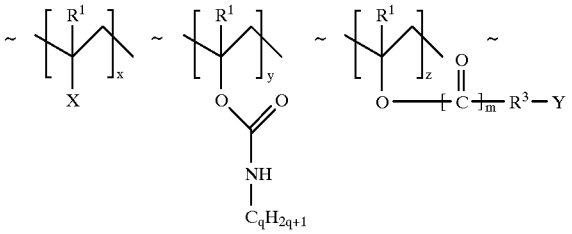

wherein each $R^1$ is independently selected from the group of hydrogen and an aliphatic group (preferably having 1 to 4 carbon atoms), each X is independently selected from the group of hydrogen; a hydroxyl group; a halide; an alkylene, an alkenylene, an arylene group, or mixture thereof, having a terminal hydroxyl group;

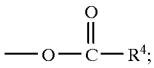

—O—$R^5$; and —$R^6$; wherein each $R^4$, $R^5$, and $R^6$ is independently selected from the group of an aliphatic group, an aromatic group and mixtures thereof; and wherein each $R^3$ is independently a divalent organic linking group; m is 0 or 1; q is about 5 or more; and each Y is independently a functionality capable of being ionized or the ioinized form thereof Thus, each Y is independently capable upon neutralization of dispersing (preferably, solubilizing) the polymer in water. Preferred relative proportion of the units in a polymer according to the present invention is as follows: x is about 0 to about 70; y is about 5 to about 95; and z is about 5 to about 50; wherein x, y and z each represent mole percent.

As stated above, the water solubilizing group contains a functionality, labeled Y, that is capable of being ionized (such as an acidic group) or is the ionic form thereof that may be anionic or cationic. Examples of suitable anionic groups, which may be formed from acidic groups, include an anion selected from the group of —$OSO_2O^-$, —$SO_2O^-$, —$CO_2^-$, $(—O)_2P(O)O^-$, —$OP(O)(O^-)_2$, —$P(O)(O^-)_2$, —$P(O^-)_2$, and —$PO(O^-)_2$. Examples of suitable cationic groups include organo-ammonium groups that include a cation selected from the group of —$NH(R^8)_2^+$ and —$N(R^8)_3^+$, wherein $R^8$ is selected from the group of a phenyl group; a cycloaliphatic group; and a straight or branched aliphatic group having about 1 to about 12 carbon atoms. Preferably, $R^8$ is a lower alkyl group of about 1 to about 4 carbon atoms.

A. Polymeric Backbone Component

A polymeric additive according to the invention includes a backbone of repeating ethylene containing (e.g., vinyl-derived) units having substituents attached thereto, as shown above and can be made by a variety of known methods. Preferably, it is made by modifying the polymeric backbone component by adding urethane linked hydrocarbons and water solubilizing groups, both as shown above. For example, a polymeric backbone component preferably includes repeating ethylene containing units, such as a polyethylene, wherein the polymer has at least one pendant hydroxyl group attached thereto. This can be either purchased or prepared from smaller units.

For example, the polymeric backbone can be formed from one or more precursors including, but not limited to, the group of ethylene, vinyl halides (e.g., vinylidene chloride), vinyl ethers (e.g., vinyl propyl ether), vinyl esters (e.g., vinyl acetate), acrylic esters (e.g., methyl acrylate), methacrylic esters (e.g., ethyl methacrylate), acids such as acrylic acid and methacrylic acid, amides (e.g., acrylamide), aromatic vinyl compounds (e.g., styrene), heterocyclic vinyl monomers, allyl compounds, esters and half esters of diacids (e.g., diethyl maleate), and mixtures thereof Of these, those that do not contain acrylate groups are the more preferred.

Preferred polymeric backbone components are prepared from polymerizing and copolymerizing vinyl esters to afford, for example, polyvinyl acetate and ethylene-vinyl acetate copolymer, both fully or partially hydrolyzed, to form a polyvinyl alcohol. Some commercially available materials may retain acetate groups. These materials are also referred to herein as vinyl-derived and are preferably non-acrylate derived.

Accordingly, a preferred repeating backbone unit, prior to modification by an isocyanate containing hydrocarbon and a water solubilizing compound, in a polymer according to the invention has the formula:

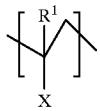

wherein in the polymer each $R^1$ is independently selected from the group of hydrogen and an aliphatic group. Each X moiety is preferably independently selected from the group of hydrogen; a hydroxyl group; a halide; an alkylene, an alkenylene, an arylene group, or mixtures thereof, having a terminal hydroxyl group;

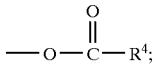

—O—$R^5$; and —$R^6$; wherein each $R^4$, $R^5$, and $R^6$ are independently selected from the group of an aliphatic group, an aromatic group, and mixtures thereof, with the proviso that at least one of the X substituents on the polymeric backbone is a hydroxyl group (prior to modification). It will be understood by one of skill in the art that because each $R^1$ and X groups are independently selected from the above lists, the polymeric backbone component (prior to modification) may contain more than one type of repeating unit. This is also true for the polymeric additive according to the invention. One skilled in the art will further recognize that if X contains an alkylene, an alkenylene, an arylene group, or mixtures thereof, having a terminal hydroxyl group that is the point of modification, the resultant polymer will have intervening groups between the backbone and the oxygen link.

Isocyanate-containing Hydrocarbons

As mentioned above, a composition according to the invention includes a polymer formed from modification of an ethylene-containing, preferably a vinyl-derived, backbone, as described above, with certain isocyanate-containing hydrocarbons. These hydrocarbons are also referred to herein as "hydrocarbon isocyanates." For example, reaction of a polyvinyl alcohol with an isocyanate results in the modification of hydroxyl groups on the backbone forming urethane (or carbamate) groups. Preferably, the urethane links long side chain hydrocarbons terminated with methyl groups.

Preferably, these isocyanate-containing hydrocarbons are capable of forming urethane linked nitrogen-bonded hydrocarbon side chains having more than about 5 carbon atoms in length and a terminal methyl group. More preferably, the nitrogen bonded hydrocarbon side chains have at least about 12 carbon atoms, even more preferably at least about 14 and, most preferably, at least about 16 carbon atoms in length. The length of the hydrocarbon side chain affects the melting point of the polymer prepared therefrom, as taught by Dahlquist et al. (See., e.g., U.S. Pat. No. 2,532,011). If the length of the hydrocarbon side chain is too short, i.e., less than about 5, the long chain monomer does not crystallize at room temperature.

Typically, hydrocarbon isocyanates have the general formula:

$$(C_qH_{2q+1}).N{=}C{=}O$$

where q preferably has a value of more than about 5, more preferably, at least about 12, even more preferably at least about 14, and most preferably, at least about 16. One preferred hydrocarbon isocyanate for use in the present invention has the formula:

$$C_{18}H_{37}.N{=}C{=}O$$

(octadecyl isocyanate) which has about 18 carbons in the nitrogen-linked alkyl chain. When, for example, this is reacted with polyvinyl acetate (partially or fully hydrolyzed), the resulting N-octadecyl carbamate side chains have the structure indicated by the formula:

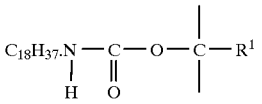

where the carbon atom at the extreme right is one of those in the backbone, wherein each $R^1$ is independently hydrogen or an aliphatic group. The nitrogen-linked group need not be a continuous aliphatic hydrocarbon chain, and may include other atoms or radicals capable of being present in the isocyanates.

Accordingly, one preferred unit in a polymer of the present invention having a urethane linked nitrogen-bonded hydrocarbon side chain having about 5 carbon atoms or more in length and a terminal methyl group attached thereto is:

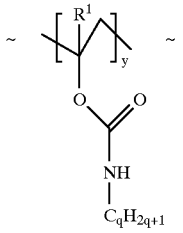

wherein q is about 5 or more, and each $R^1$ is independently selected from the group of hydrogen or an aliphatic group and y is about 5 to about 95 mole percent of the polymer.

Water Solubilizing Compounds

Water solubilizing groups preferably include functionalities capable of being ionized or are the ionic form thereof These water solubilizing groups are hydrophilic so that when present in the polymer, they assist in solubility or dispersibility of the polymer in water and likely enhance the stability of aqueous water dispersions of the polymer. Typically, urethanes having long hydrocarbon side chains are hydrophobic and not readily water dispersible. Thus, a water solubilizing group may be incorporated in a polymer, in a nonionized form, that subsequently ionizes with the addition of a salt forming compound allowing the polymer to be dispersed in water.

It is preferred to incorporate such water solubilizing groups into a polymer in accordance with the invention by means of a water solubilizing compound. "Water solubilizing compound" refers to a compound that has a water solubilizing group, as defined above, and is capable of being attached to the polymeric backbone via an oxygen linkage, preferably an ester linkage. Therefore, a water solubilizing compound may have the water solubilizing group in an ionized or a nonionized form. For example, a carboxylic acid group is an acidic water solubilizing group that can be ionized by salt formation, for instance, by reaction with a base.

The water solubilizing groups preferably are derivatives of carboxylic acids and more preferably, derivatives of cyclic anhydrides. Most preferred water solubilizing groups may include aromatic moieties or alkyl chains that may be saturated or unsaturated, and linear or branched. Examples of preferred water solubilizing compounds that form water solubilizing groups, when attached to the polymer backbone, are succinic anhydride, maleic anhydride, glutaric anhydride, phthalic anhydride, and 2-sulfobenzoic acid cyclic anhydride. Other water solubilizing compounds include those capable of reacting with the polymeric backbone component to form pendant water solubilizing groups such as halo-alkyl acids, e.g. chloroacetic acid. It is believed that the functionality on the polymer, preferably an ester linked acid group, is important for water dispersibility of the polymer because it can be neutralized by a base. As mentioned above, water dispersibility of the polymer is preferably accomplished by ionization of the water solubilizing group, preferably by the formation of a salt by the water solubilizing group. That is, the nonionized form of the water solubilizing group is soluble in an organic solvent (such as toluene) while the salt (or ionized) form of the water solubilizing group is dispersible in water. Preferably, the salt forming compound may either be an organic base or an inorganic base. Preferable organic bases include tertiary amines. Preferable inorganic bases include hydroxides or carbonates of alkali metals (e.g., potassium hydroxide) or metal oxides (e.g., zinc oxide). More preferable salt forming compounds are selected from the group of ammonia, ammonium hydroxide, trimethylamine, triethylamine, tripropylamine, triisopropylamine, tributylamine, triethanolamine, diethanolamine, dimethylethanolamine, and mixtures thereof Triethylamine is an even more preferred salt forming compound.

Accordingly, another preferred unit in a polymer included in at least one binder system of the present invention having a water solubilizing group attached thereto is:

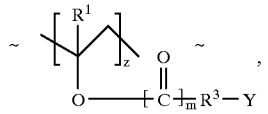

wherein each $R^1$ is independently selected from the group of hydrogen or an aliphatic group, each $R^3$ is independently a divalent organic linking group, m is 0 or 1, each Y is independently a functionality capable of being ionized or the ionic form thereof, and z is about 5 to about 50 mole percent of the polymer.

Consequently, a polymer so formed possesses a desirable structure exhibiting good film forming characteristics (i.e., polymeric particles have a propensity to coalesce and form a film) as well as good surface adhesion when coated on a substrate surface. While not wishing to be bound by any particular theory, it is believed that including a polymeric additive in at least one binder system according to the invention minimizes loading in the abrasive article during an abrasion process. Surprisingly, it was found that an abrasive article in accordance with the present invention out performed an abrasive article that did not include a polymeric additive in wood sanding tests, even when the polymeric additive was present in a small amount. Preferably, a polymeric additive is present in an amount of about 0.1% by weight to about 30% by weight, more preferably, about 0.1% by weight to about 15% by weight, even more preferably, about 0.1 to about 5.0% by weight, and most preferably, about 0.1% by weight to about 2.0% by weight.

II. Thermosetting Resin

A thermosetting resin useful in an abrasive article according to the invention preferably is selected from the group of a phenolic resin, an aminoplast resin having pendant α,β-unsaturated carbonyl groups, a urethane resin, an epoxy resin, a urea-formaldehyde resin, an isocyanurate resin, a melamine-formaldehyde resin, an acrylate resin, an acrylated isocyanurate resin, an acrylated urethane resin, an acrylated epoxy resin, a bismaleimide resin, and mixtures thereof, each as described above. Phenolic resins are one preferred thermosetting resin in the present invention because of their thermal properties, availability, cost, ease of handling, and water solubility. Preferably, the thermosetting resin is present in an amount of about 99.9% to about 70% by weight, more preferably, about 85% by weight to about 99.9% by weight, even more preferably, about 95% by weight to about 99.9% by weight, and most preferably, about 98% by weight to about 99.9% by weight.

Abrasive Particles

Abrasive particles useful in the invention can be of any conventional grade utilized in the formation of abrasive articles. Suitable abrasive particles can be formed of, for example, flint, garnet, ceria, aluminum oxide (including fused and heat-treated aluminum oxide), alumina zirconia including fused alumina zirconia as disclosed, for example, in U.S. Pat. Nos. 3,781,172; 3,891,408; and 3,893,826, and commercially available from the Norton Company of Worcester, Mass., under the trade designation "NorZon", diamond, silicon carbide (including refractory coated silicon carbide as disclosed, for example, in U.S. Pat. No. 4,505,720, silicone nitride, alpha alumina-based ceramic material, as disclosed, for example, in U.S. Pat. Nos. 4,518,397; 4,574,003; 4,744,802; 4,770,671; 4,881,951; and 5,011,508, titanium diboride, boron carbide, tungsten carbide, titanium carbide, iron oxide, cubic boron nitride, and mixtures thereof.

Abrasive particles may be individual abrasive grains or agglomerates of individual abrasive grains. Abrasive particles may have a particle size ranging from about 0.01 micrometers to about 1500 micrometers, preferably from about 1 micrometer to about 1000 micrometers. The frequency (concentration) of the abrasive particles on the backing depends on the desired application and is within the purview of the skilled artisan. The abrasive particles can be oriented or can be applied without orientation, depending upon the requirements of the particular abrasive product.

The abrasive particles may be applied as an open or closed coat. A closed coat is one in which the abrasive particles completely cover the major surface of the backing. In an open coat, the abrasive particles cover about 20% to about 90% of the major surface of the backing, typically about 40% to about 70%. For constructions in accordance with the present invention, open coating of abrasive particles is typically utilized.

An abrasive article of the present invention may contain a blend of abrasive grains and diluent particles. Diluent particles can be selected from the group consisting of: (1) an inorganic particle (non-abrasive inorganic particle), (2) an organic particle, (3) an abrasive agglomerate containing abrasive grains, (4) a composite diluent particle containing a mixture of inorganic particles and a binder, (5) a composite diluent particle containing a mixture of organic particles and a binder.

Optional Additives

Optional additives, such as, for example, fillers (secondary grinding aids), fibers, antistatic agents, lubricants, wetting agents, surfactants, pigments, dyes, coupling agents, plasticizers, release agents, suspending agents, and curing agents including free radical initiators and photoinitiators, may be included in abrasive articles of the present invention. The optional additives may be included in a binder formed from a binder precursor. These optional additives may further require that additional components be included in the binder precursor composition to aid in curing; for example, a photoinitiator may be required when acrylates are used. The amounts of these materials can be selected to provide the properties desired.

For example, a binder including a binder precursor can further include a wetting agent, preferably, an anionic surfactant, i.e., a surfactant capable of producing a negatively charged surface active ion.

Examples of useful fillers for this invention include: metal carbonates, such as calcium carbonate (chalk, calcite, marl, travertine, marble and limestone), calcium magnesium carbonate, sodium carbonate, magnesium carbonate; silica (such as quartz, glass beads, glass bubbles and glass fibers); silicates, such as talc, clays, montmorillonite, feldspar, mica, calcium silicate, calcium metasilicate, sodium aluminosilicate, sodium silicate; metal sulfates, such as calcium sulfate, barium sulfate, sodium sulfate, aluminum sodium sulfate, aluminum sulfate; gypsum; vermiculite; wood flour; aluminum trihydrate; carbon black; metal oxides, such as calcium oxide, aluminum oxide, titanium dioxide; and metal sulfites, such as calcium sulfite. Examples of useful fillers also include silicon compounds, such as silica flour, e.g., powdered silica having a particle size of from about 4 to 10 mm (available from Akzo Chemie America, Chicago, Ill.), and calcium salts, such as calcium carbonate and calcium metasilicate (available under the trade designations, "WOLLASTOKUP" and "WOLLASTONITE" from Nyco Company, Willsboro, N.Y.).

Examples of antistatic agents include graphite, carbon black, vanadium oxide, humectants, and the like. These antistatic agents are disclosed in U.S. Pat. Nos. 5,061,294; 5,137,542; and 5,203,884.

A coupling agent can provide an association bridge between the binder and the filler particles. Additionally the coupling agent can provide an association bridge between the binder and the abrasive particles. Examples of coupling agents include silanes, titanates, and zircoaluminates. There are various means to incorporate the coupling agent. For example, the coupling agent may be added directly to the binder precursor. The binder may contain anywhere from about 0.01 to 3% by weight coupling agent. Alternatively, the coupling agent may be applied to the surface of the filler particles or the coupling agent may be applied to the surface of the abrasive particles prior to being incorporated into the abrasive article. The abrasive particles may contain anywhere from about 0.01 to 3% by weight coupling agent.

Curing agents such as an initiator may be used, for example, when the energy source used to cure or set a binder precursor is heat, ultraviolet light, or visible light in order to generate free radicals. Examples of curing agents such as photoinitiators that generate free radicals upon exposure to ultraviolet light or heat include organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, and mixtures thereof. Commercially available photoinitiators include those available from Ciba Geigy Company, Hawthorne, N.Y., under the trade designations "IRGACURE 651" and "IRGACURE 184" and those available from Merck & Company, Incorporated, Rahway, N.J., under the trade designation "DAROCUR 1173" (all of which generate free radicals upon exposure to ultraviolet light) and those available from Ciba Geigy Company, Hawthorne, N.Y., under the trade designation "IRGACURE 369" (which generates free radicals upon exposure to visible light). In addition, initiators which generate free radicals upon exposure to visible light as described in U.S. Pat. No. 4,735,632. Typically, an initiator is used in amounts ranging from about 0.1% to about 10% by weight, preferably about 2% to 4% by weight, based on the weight of the binder precursor.

It is also within the scope of the present invention to include a secondary grinding aid. Secondary grinding aids encompass a wide variety of different materials and can be inorganic or organic based. Examples of chemical groups of grinding aids include waxes, organic halide compounds, halide salts and metals and their alloys. Examples of such materials include chlorinated waxes like tetrachloronaphthalene, pentachloronaphthalene, and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metals include tin, lead, bismuth, cobalt, antimony, cadmium, iron, and titanium. Other miscellaneous grinding aids include sulfur, organic sulfur compounds, graphite, and metallic sulfides. The above mentioned examples of grinding aids are meant to be a representative listing of grinding aids, and they are not meant to encompass all grinding aids usable.

It is further within the scope of the present invention to include a binder system containing a polymeric additive and a thermosetting resin, as described above, as a size coat in an abrasive article that also includes a supersize coat of a metal salt of a fatty acid, such as zinc stearate, lithium stearate, and the like. Preferably, the supersize coat is prepared from a composition including a metal salt of a fatty acid and a binder precursor, as described above.

EXAMPLES

The objects, features and advantages of the present invention illustrated in the following examples, which incorporate particular materials and amounts, should not be construed to unduly limit this invention. All materials are commercially available unless otherwise stated or apparent. All parts, percentages, ratios, etc., in the examples are by weight unless otherwise indicated.

GENERAL PROCEDURE FOR PREPARING ABRASIVE ARTICLES

Examples 1–4 and Comparative Examples A–D

All examples were coated abrasives having having a backing of a Y weight woven cotton cloth available from Milliken & Co., Spartanburg, S.C., weighing 523 g/m$^2$, which was pretreated to prepare the backing for receiving a make coat. This backing also had a conductive backsize formed by applying a backsize formulation containing conductive carbon black which functions to eliminate static formed during wood sanding.

A coatable mixture for producing a make coating for the backing was prepared by mixing 69 parts of 76% solids phenolic resin (48 parts phenolic resin), 52 parts non-agglomerated calcium carbonate filler (dry weight basis), and a solution of 90 parts water/10 parts propylene glycol monomethyl ether to form a make coating which was 84% solids, with a wet coating weight of 71 g/m$^2$. The make coating was applied in each case via knife coating. Next, grade P100 (ANSI standard B74.18 average particles size of 150 micrometers) fused aluminum oxide abrasive particles were electrostatically coated onto the uncured make coating with a weight of 200 g/m$^2$. Then, the resulting constructions received a precure of 15 minutes at 65° C., followed by 75 minutes at 88° C.

For Comparative Examples A–D, a 76% solids coatable phenolic resin mixture suitable for forming a size coating (having a composition prepared by mixing 69 parts of 76% solids phenolic resin [48 parts phenolic resin], 52 parts non-agglomerated calcium carbonate filler [dry weight basis], and a solution of 90 parts water/10 parts propylene glycol monomethyl ether) was then applied over the abrasive particles/make coat construction via two-roll coater. The wet size coating weight in each case was about 146 g/m$^2$.

For Examples 1–4, a 76% solids coatable phenolic resin mixture suitable for forming a size coating as in Comparative Examples A–D was used with a 10% solids aqueous dispersion of a polymeric additive, described below, was included in the mixture at 5.0% by weight. The formulations of the size coat mixture for Examples 1–4 are listed in Table 1 below. Make, mineral, and size coating weights are listed in Table 2.

Synthesis of a Polymeric Additive

A polymeric additive was prepared having a neutralized water solubilizing group dispersed in water by starting with a 98% hydrolyzed (by mole) polyvinyl acetate, as described in assignee's copending application Docket No. 53510USA1A, U.S. patent application Ser. No. 08/934,263, filed on Sep. 19, 1997 (DiZio, et al.), incorporated herein by reference.

A polymeric backbone component of a low molecular weight polyvinyl alcohol prepared by hydrolyzing (98% by mole) polyvinyl acetate available under the trade designation AIRVOL 103 (100 g) and N-methyl-2-pyrrolidinone solvent (333 g) were added to a vessel equipped with a mechanical stirrer (glass rod, teflon blade) and a Dean/Stark trap with a nitrogen inlet. The mixture was heated in an oil bath at 125° C. for 30 minutes with stirring to dissolve the polyvinyl alcohol. Heptane (enough to fill the Dean/Stark trap plus 50 ml) was added and the mixture heated at reflux to dewater the solution (30 minutes). The heptane was then distilled off to redissolve the polymer (about 30 minutes). An isocyanate-containing hydrocarbon, octadecyl isocyanate, (484 g) was added over about 5 minutes to the solution with stirring. After about 30 minutes, a water solubilizing compound, solid glutaric anhydride, (34.9 g) was added all at once with stirring. After about 4.5 hours, the solution was cooled to 100° C. and methanol (1500 ml) was added with stirring. The mixture was heated at reflux and stirred for 5 minutes and the liquid portion then decanted off while still hot. This step was repeated using 1400 ml of methanol, and the methanol then removed by distillation at 125° C. Isopropyl alcohol (2500 g) and a salt forming compound, triethylamine, (34.1 g) were added and the resulting mixture heated at reflux until the solid product was dissolved. With rapid stirring, hot deionized water (80° C., 5570 ml) was added over 1 minute and the solution heated at reflux to distill off 3531 g of liquid. The pH of the resulting solution was adjusted to 8 with triethylamine and the solution filtered over diatomaceous earth. The resulting 12% dispersion of polymeric composition in water was slightly yellow/transparent to beige/cloudy in appearance. Water was added to dilute to 10% solids.

Typical chemical shifts for the polymeric additive were shown by NMR analysis using methodology that included dissolving 100 mg of the prepared polymer with heat in 1 gm of deuterated chloroform. The sample was then loaded into a Varian INOVA 400 MHz Spectrophotometer (Varian NMR Instruments, Palo Alto, Calif.). $^1$H-NMR ($CDCl_3$, 400 MHz) delta 4.7–5.2 (at least two overlapping broad peaks, N$\underline{H}$ resonances of the urethane and R—OC$\underline{H}$ backbone resonances where R is not H), 3.8 (broad, O$\underline{H}$ of the alcohol), 3.7 (broad, HO—C$\underline{H}$ on backbone), 3.1 (broad, NHC$\underline{H}_2$ methylene attached to urethane), 2.4 (broad, OOCC$\underline{H}_2$CH$_2$C$\underline{H}_2$COOH methylenes attached to carbonyls on the water solubilizing group), 1.1–2.0 (multiple peaks dealing with the methylene hydrogens), 0.88 (triplet, C$\underline{H}_3$ terminal methyl group of urethane linked nitrogen-containing long chain alkyl substituent). Thus, integration of signals obtained by NMR analysis, except that the mole percent ratio of the alkyl, acid and alcohol portions of this polymeric additive were derived from integration of the signals located at 0.88, 2.4, and 3.7 ppm, respectively, in the spectrum. Thus, integration of signals obtained by NMR showed the Alkyl/Acid/OH molar ratio to be 71/12/17.

TABLE 1

SIZE COAT FORMULATIONS FOR EXAMPLES 1–4

| Components | wt. % |
|---|---|
| RP1 (a conventional resole phenolic resin prepared by reacting a molar excess of formaldehyde with phenol catalyzed with caustic resulting in 75% solids) | 100 |
| 3 micron calcium carbonate filler available from ECC International, Sylacauga, Alabama under the trade designation "MICROWHITE" | 20 |
| an aqueous dispersion @10% solids containing a polymeric additive | 5.0 |
| A glycol ester of fatty acid commercially available from Interstab Chemicals Inc. under the trade designation "Interwet 33" | 0.2 |
| $H_2O$ | 12.3 |

TABLE 2

COATING WEIGHTS FOR EXAMPLES 1 to 4

| Example | Make Resin ($g/m^2$) | Mineral Weight ($g/m^2$) | Size Resin ($g/m^2$) |
|---|---|---|---|
| 1 | 92 | 198 | 118 |
| 2 | 95 | 189 | 114 |
| 3 | 95 | 189 | 147 |
| 4 | 88 | 187 | 138 |

Examples 1–4 and Comparative Examples A–D then received a thermal cure of 30 minutes at 88° C. followed by 12 hours at 100° C. After this thermal cure, the coated abrasives were single flexed (i.e., passed over a roller at an angle of 90° to allow a controlled cracking of the make and size coatings), then converted into 7.6 cm by 168 cm coated abrasive belts.

Examples 1–4 were compared with Comparative Examples A–D using the ELB Particle Board Normal Force Test Procedure, described below, and the results are shown in Table 3. Typically, saw dust loading leads to both higher normal forces and, eventually, burning of both the loaded sawdust and the workpiece. Normal force (Fn) is the penetrating force of the abrasive article into the workpiece. The lower Fn is, the more effectively the abrasive article penetrates the workpiece. When an abrasive article penetrates the workpiece more effectively, grinding is more efficient.

WOODSANDING NORMAL FORCE TEST

Loading of sawdust frequently occurs during wood sanding with an abrasive belt which subsequently leads to burning of the sawdust on the abrasive surface of the belt as well as burning on the sanding path of the wood workpiece adjacent to the burning on the abrasive surface of the belt. Burning of the wood workpiece surface is not an aesthetically desired result because it is counterproductive to providing an attractive wood surface. In addition, burning of loaded sawdust on the abrasive surface of the belt surface renders the abrasive belt useless and, during experimental testing, is usually referred to as an experimental endpoint. The antiloading size components of the present invention are designed to prevent or minimize or delay loading of sawdust.

In order to determine antiloading properties in the context of sanding a wood or wood-like substrate, a Woodsanding Normal Force Test was conducted. Coated abrasives described in the section for Examples 1–4 and Comparative Examples A–D were converted to 168 cm by 7.6 cm continuous belts and installed on an ELB reciprocating bed grinding machine available from ELB Grinders Corp., Mountainside, N.J., under the trade designation "ELB Type SPA 2030ND".

The effective cutting area of the abrasive belts was 7.6 cm by 168 cm. The workpieces abraded by these belts were particle boards of these dimensions: 1.6 cm width by 38 cm length by 28 cm height. Abrading was conducted along the 1.6 cm by 38 cm edge. The particle board workpiece was mounted on a reciprocating table. The speed of the abrasive belt was 1,525 rpm. The table speed, at which the workpiece traversed, was 12.2 meters per minute. The downfeed increment of the abrasive belt was 2.0 mm/pass of the workpiece. The process used was conventional surface grinding wherein the workpiece was reciprocated beneath the rotating abrasive belt with incremental downfeeding between each pass. This sanding was carried out dry.

The normal force ($F_n$) was monitored near the end of sanding each 12.2 cm segment of particle board. As sanding proceeds, the normal force increases. In general, the lower the normal force, the better the belt is performing the sanding of the workpiece. Saw dust loading leads to both higher normal forces and eventually burning of both the loaded sawdust and the workpiece which becomes a "BURNING" end point. The end point for this test is either burning and/or reaching 445 Newtons (NT) of normal force ($F_n$). The total amount of particle board cut in cm (height) is reported for each abrasive example evaluated.

The downfeed sequences are as follows: Table 3 constant 2.0 mm/Pass. This downfeed condition is continued until either the belt fails by burning and/or the normal force ($F_n$) exceeds 445 Newtons (NT) during sanding on the narrow edge of the particle board. The particle board characteristics may vary due to the relative humidity and the season of the year.

TABLE 3

PARTICLE BOARD/NORMAL FORCE TEST

| Example | Fn (NT) @24cm/ 2.0 mm/pass | Cut $(cm)^3$/ $Path(cm)^2$ | % of Comparative Ex. A/B/C/D |
|---|---|---|---|
| Comp. Ex. A | FAIL | 3.87 | 100 |
| Ex. 1 | 305 | 10.10 | 263 |
| Comp. Ex. B | 365 | 8.03 | 100 |
| Ex. 2 | 226 | 15.32 | 191 |
| Comp. Ex. C | 304 | 11.73 | 100 |
| Ex. 3 | 148 | 20.44 | 174 |
| Comp. Ex. D | FAIL | 3.82 | 100 |
| Ex. 4 | 230 | 15.32 | 401 |

Examples 1–4 perform longer prior to loading and burning in comparison to Comparative Examples A–D, because the polymeric additive used in Examples 1–4 is believed to function to reduce the sawdust loading of the coated abrasives. Comparative Examples A–D sand at higher normal forces than Examples 1–4 in Table 3. Examples 3 and 4, having higher size levels, tend to perform longer than examples with less size coating. Example 3, having a higher size level than Example 2 (147 vs. 114 $g/m^2$) performed very well as indicated by the low $F_n$ of 148 NT at 24 cm.

WOODSANDING NORMAL FORCE TEST FOR SOUTHERN YELLOW PINE

In order to determine antiloading properties of southern yellow pine, a Woodsanding Normal Force Test very similar to that above for particle board was conducted. Coated abrasives described in the section for Example 3 and Comparative Examples C were converted to 168 cm by 7.6 cm continuous belts and installed on an ELB reciprocating bed grinding machine available from ELB Grinders Corp., Mountainside, N.J., under the trade designation "ELB Type SPA 2030ND".

The effective cutting area of the abrasive belt was 7.6 cm by 168 cm. The workpiece abraded by these belts was southern yellow pine of these dimensions: 1.9 cm width by 38 cm length by 18.4 cm height. Abrading was conducted along the 1.9 cm by 38 cm edge. The southern yellow pine workpiece was mounted on a reciprocating table. The speed of the abrasive belt was 1,525 rpm. The table speed, at which the workpiece traversed, was 12.2 meters per minute. The downfeed increment of the abrasive belt was 3.0 mm/pass of the workpiece. The process used was conventional surface grinding wherein the workpiece was reciprocated beneath the rotating abrasive belt with incremental downfeeding between each pass. This sanding was carried out dry.

The normal force ($F_n$) was monitored near the end of sanding each 15.2 cm segment of southern yellow pine. The end point for this test is either burning and/or reaching 990 Newtons (NT) of normal force ($F_n$). The total amount of southern yellow pine cut in cm(height) is reported for each abrasive example evaluated.

Example 3 was compared with Comparative Examples C using the ELB Particle Board Normal Force Test Procedure and the results are shown in Table 4.

The downfeed sequences are as follows: Table 4 constant 3.0 mm/Pass. This downfeed condition is continued until either the belt fails by burning and/or the normal force ($F_n$) exceeds 990 Newtons (NT) during sanding on the narrow edge of the southern yellow pine. The southern yellow pine characteristics may vary due to the relative humidity and the season of the year. Southern yellow pine sands at higher normal forces than particle board.

TABLE 4

NORMAL FORCE TEST (YELLOW PINE)

| Example | Fn (NT) @76cm/ 3.0 mm/pass | Cut $(cm)^3$/ $Path(cm)^2$ | % of Comparative Ex. C |
|---|---|---|---|
| Comp. Ex. C | FAIL | 12.66 | 100 |
| Ex. 3 | 531 | 60.90 | 481 |

Example 3 outperformed Comparative Examples C prior to loading and burning. It is believed that the polymeric additive used in Example 3 functions to reduce the sawdust loading of the coated abrasive. Comparative Example C also sands at higher normal force than Example 3, as shown in Table 4.

Patents and patent applications disclosed herein are hereby incorporated by reference as if individually incorporated. It is to be understood that the above description is intended to be illustrative, and not restrictive. Various modifications and alterations of this invention will become apparent to those skilled in the art from the foregoing description without departing from the scope and the spirit of this invention, and it should be understood that this invention is not to be unduly limited to the illustrative embodiments set forth herein.

What is claimed is:

1. An abrasive article comprising:

a backing having a first major surface and a second major surface;

a plurality of abrasive particles; and at least one binder system formed from a composition comprising a thermosetting resin and a polymeric additive comprising a polymeric backbone component having substituents attached thereto, wherein the substituents comprise:

at least one urethane linked nitrogen-bonded hydrocarbon side chain having about 5 carbon atoms or more in length and a terminal methyl group; and at least one oxygen linked water solubilizing group, wherein the binder system adheres the plurality of abrasive particles to the first major surface of the backing.

2. The abrasive article of claim 1 wherein the substituents further comprise hydrogen; a hydroxyl group; a halide; an alkyl group;

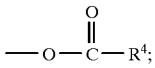

—O—$R^5$; —$R^6$; and mixtures thereof wherein each $R^4$, $R^5$, and $R^6$ are independently selected from the group of an aliphatic, an aromatic group, and mixtures thereof.

3. The abrasive article of claim 2 wherein the water solubilizing group comprises an anion selected from the group of —$OSO_2O^-$, —$SO_2O^-$, —$CO_2^-$, $(—O)_2P(O)O^-$, —$OP(O)(O^-)_2$, —$P(O)(O^-)_2$, —$P(O^-)_2$, and —$PO(O^-)_2$.

4. The abrasive article of claim 1 wherein the water solubilizing group comprises a cation selected from the group of —$NH(R^8)_2{}^+$ or —$N(R^8)_3{}^+$, wherein $R^8$ is selected from the group of a phenyl group; a cycloaliphatic group; and a straight or branched aliphatic group having about 1 to about 12 carbon atoms.

5. The abrasive article of claim 1 wherein the water solubilizing group comprises an acidic group capable of forming an anionic species.

6. The abrasive article of claim 1 wherein the plurality of abrasive particles and the at least one binder system together comprise a plurality of precisely shaped composites on the first major surface of the backing.

7. The abrasive article of claim 1 wherein the thermosetting resin is selected from the group of a phenolic resin, an aminoplast resin having pendant α,β-unsaturated carbonyl groups, a urethane resin, an epoxy resin, a urea-formaldehyde resin, and mixtures thereof.

8. The abrasive article of claim 1 wherein the thermosetting resin comprises a phenolic resin.

9. The abrasive article of claim 1 wherein the at least one binder system is formed from a composition further comprising an optional additive selected from the group of a filler, a fiber-containing material, an antistatic agent, a lubricant, a wetting agent, a surfactant, a pigment, a dye, a coupling agent, a plasticizer, a release agent, a suspending agent, a curing agent, and a compatible mixture thereof.

10. An abrasive article comprising:

a backing having a first major surface and a second major surface;

a plurality of abrasive particles;

a make coat binder system formed from a binder precursor, wherein the make coat binder system bonds the plurality of abrasive particles to the first major surface of the backing; and a size coat binder system formed from a composition comprising a thermosetting resin and a polymeric additive comprising a polymeric backbone component having substituents attached thereto, wherein the substituents comprise:

at least one urethane linked nitrogen-bonded hydrocarbon side chain having about 5 carbon atoms or more in length and a terminal methyl group; and at least one oxygen linked water solubilizing group, wherein the size coat binder system forms at least a portion of a peripheral surface of the abrasive article.

11. The abrasive article of claim 10 wherein the substituents further comprise hydrogen; a hydroxyl group; a halide; an alkyl group;

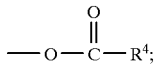

—O—$R^5$; —$R^6$; and mixtures thereof, wherein each $R^4$, $R^5$, and $R^6$ are independently selected from the group of an aliphatic, an aromatic group, and mixtures thereof.

12. The abrasive article of claim 10 wherein the water solubilizing group comprises an anion selected from the group of —$OSO_2O^-$, —$SO_2O^-$, —$CO_2^-$, $(—O)_2P(O)O^-$, —$OP(O)(O^-)_2$, —$P(O)(O^-)_2$, —$P(O^-)_2$, and —$PO(O^-)_2$.

13. The abrasive article of claim 10 wherein the water solubilizing group comprises a cation selected from the group of —$NH(R^8)_2^+$ or —$N(R^8)_3^+$, wherein $R^8$ is selected from the group of a phenyl group; a cycloaliphatic group; and a straight or branched aliphatic group having about 1 to about 12 carbon atoms.

14. The abrasive article of claim 10 wherein the water solubilizing group comprises an acidic group capable of forming an anionic species.

15. The abrasive article of claim 10 wherein the thermosetting resin is selected from the group of a phenolic resin, an aminoplast resin having pendant α,β-unsaturated carbonyl groups, a urethane resin, an epoxy resin, a urea-formaldehyde resin, and mixtures thereof.

16. The abrasive article of claim 15 wherein the thermosetting resin comprises a phenolic resin.

17. The abrasive article of claim 10 wherein the size coat binder system is formed from a composition further comprising an optional additive selected from the group of a filler, a fiber-containing material, an antistatic agent, a lubricant, a wetting agent, a surfactant, a pigment, a dye, a coupling agent, a plasticizer, a release agent, a suspending agent, a curing agent, and a compatible mixture thereof.

18. The abrasive article of claim 10 wherein the abrasive article exhibits an increase in total cut in a Woodsanding Normal Force Test as compared to an abrasive article including a size coat binder system formed from a composition containing substantially no polymeric additive.

19. An abrasive article comprising:

a backing having a first major surface and a second major surface;

a plurality of abrasive particles;

a make coat binder system formed from a first binder precursor, wherein the make coat binder system bonds the plurality of abrasive particles to the first major surface of the backing; and a size coat binder system formed from a composition comprising a thermosetting resin and a polymeric additive comprising:

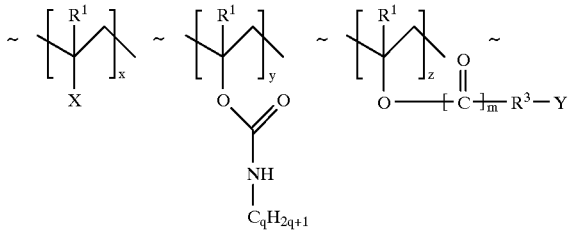

wherein each $R^1$ is independently selected from the group of hydrogen and an aliphatic group, each X is independently selected from the group of hydrogen; a hydroxyl group; a halide; an alkylene, an alkenylene, an arylene group, or mixtures thereof, having a terminal hydroxyl group;

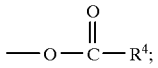

—O—$R^5$; and —$R^6$, wherein each $R^4$, $R^5$ and $R^6$ are independently selected from the group of an aliphatic group, an aromatic group, and mixtures thereof, q is about 5 or more, and wherein each $R^3$ is independently a divalent organic linking group; m is 0 or 1; and each Y is independently a functionality capable of being ionized or is the ionized form thereof, and further wherein x is about 0 to about 70; y is about 5 to about 95; and z is about 5 to about 50.

20. The abrasive article of claim 19 wherein the water solubilizing group comprises an anion selected from the group of —$OSO_2O^-$, —$SO_2O^-$, —$CO_2^-$, $(—O)_2P(O)O^-$, —$OP(O)(O^-)_2$, —$P(O)(O^-)_2$, —$P(O^-)_2$, and —$PO(O^-)_2$.

21. The abrasive article of claim 19 wherein the water solubilizing group comprises a cation selected from the group of —$NH(R^8)_2^+$ or —$N(R^8)_3^+$, wherein $R^8$ is selected from the group of a phenyl group; a cycloaliphatic group; and a straight or branched aliphatic group having about 1 to about 12 carbon atoms.

22. The abrasive article of claim 19 wherein the water solubilizing group comprises an acidic group capable of forming an anionic species.

23. The abrasive article of claim 19 wherein the thermosetting resin is selected from the group of a phenolic resin, an aminoplast resin having pendant α,β-unsaturated carbonyl groups, a urethane resin, an epoxy resin, a urea-formaldehyde resin, and mixtures thereof.

24. The abrasive article of claim 22 wherein the thermosetting resin comprises a phenolic resin.

25. The abrasive article of claim 19 wherein the size coat binder system is formed from a composition further comprising an optional additive selected from the group of a filler, a fiber-containing material, an antistatic agent, a lubricant, a wetting agent, a surfactant, a pigment, a dye, a coupling agent, a plasticizer, a release agent, a suspending agent, a curing agent, and a compatible mixture thereof.

26. The abrasive article of claim 19 further comprising a peripheral coating formed from another binder precursor, wherein the peripheral coating is formed on the size coat binder system.

27. An abrasive article comprising:

a backing having a first major surface and a second major surface;

a plurality of abrasive particles;

a make coat binder system formed from a first binder precursor, wherein the make coat binder system bonds the plurality of abrasive particles to the first major surface of the backing; and a peripheral coat binder system wherein the peripheral coat is present over the size coat formed from a composition comprising:

a thermosetting resin; and a polymeric additive comprising repeat units of the formula:

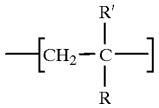

wherein each $R^1$ is independently selected from the group of hydrogen and an aliphatic group; and each R is independently selected from the group of X; a urethane-linked hydrocarbon:

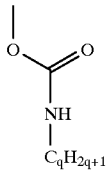

wherein q is 5 or more; and an oxygen linked water solubilizing group:

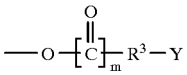

wherein each X moiety is independently selected from the group of hydrogen; a hydroxyl group; a halide; an alkylene, an alkenylene, an arylene group, or mixtures thereof, having a terminal hydroxyl group;

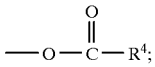

—O—$R^5$; or —$R^6$, wherein each $R^4$, $R^5$, and $R^6$ are independently selected from the group of an aliphatic group, an aromatic group, and mixtures thereof, and further wherein each $R^3$ is independently a divalent organic linking group; m is 0 or 1; and each Y moiety independently comprises a functionality capable of being ionized or is the ionized form thereof.

28. An abrasive article comprising:

a backing having a first major surface and a second major surface;

a plurality of abrasive particles; and at least one binder system formed from a composition comprising a thermosetting resin and a polymeric additive comprising an ethylene-containing backbone having substituents attached thereto, wherein the substituents comprise:

at least one urethane linked nitrogen-bonded hydrocarbon side chain having about 5 carbon atoms or more in length and a terminal methyl group; and at least one oxygen linked water solubilizing group, wherein the binder system adheres the plurality of abrasive particles to the first major surface of the backing.

29. The abrasive article of claim 28 wherein the peripheral coating is selected from the group of a size coat and a supersize coat.

30. The abrasive article of claim 28 wherein the peripheral coat binder system is formed from a composition further comprising an optional additive selected from the group of a filler, a fiber-containing material, an antistatic agent, a lubricant, a wetting agent, a surfactant, a pigment, a dye, a coupling agent, a plasticizer, a release agent, a suspending agent, a curing agent, and a compatible mixture thereof.

31. An abrasive article comprising:

a backing having a first major surface and a second major surface;

a plurality of abrasive particles; and at least one binder system formed from a composition comprising a polymeric additive comprising a polymeric backbone component having substituents attached thereto, wherein the substituents comprise:

at least one urethane linked nitrogen-bonded hydrocarbon side chain having about 5 carbon atoms or more in length and a terminal methyl group; and at least one oxygen linked water solubilizing group, wherein the binder system adheres the plurality of abrasive particles to the first major surface of the backing.

32. The abrasive article of claim 31 wherein the substituents further comprise hydrogen; a hydroxyl group; a halide; an alkyl group;

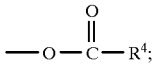

—O—$R^5$; —$R^6$; and mixtures thereof, wherein each $R^4$, $R^5$, and $R^6$ are independently selected from the group of an aliphatic, an aromatic group, and mixtures thereof.

33. A method for making a coated abrasive article, comprising the steps of:

applying a first binder precursor to a substrate;

at least partially embedding a plurality of abrasive particles in the first binder precursor;

at least partially curing the first binder precursor;

applying a composition formed by blending a thermosetting resin and a polymeric additive over the at least partially cured first binder precursor and the plurality of abrasive particles, wherein the polymeric additive comprises an ethylene-containing backbone having at least one pendant urethane linked nitrogen-bonded hydrocarbon side chain having about 5 carbon atoms or more in length and a terminal methyl group; and at least pendant one oxygen linked water solubilizing group; and curing the thermosetting resin.

34. The method of claim 33 wherein the water solubilizing group comprises an anion selected from the group of —$OSO_2O^-$, —$SO_2O^-$, —$CO_2^-$, $(—O)_2P(O)O^-$, —$OP(O)(O^-)_2$, —$P(O)(O^-)_2$, —$P(O^-)_2$, and —$PO(O^-)_2$.

35. The method of claim 33 wherein the water solubilizing group comprises a cation selected from the group of —$NH(R^8)_2^+$ or —$N(R^8)_3^+$, wherein $R^8$ is selected from the group of a phenyl group; a cycloaliphatic group; and a straight or branched aliphatic group having about 1 to about 12 carbon atoms.

36. The method of claim 33 wherein the water solubilizing group comprises an acidic group capable of forming an anionic species.

37. The method of claim 33 wherein the thermosetting resin is selected from the group of a phenolic resin, an aminoplast resin having pendant α,β-unsaturated carbonyl groups, a urethane resin, an epoxy resin, a urea-formaldehyde resin, and mixtures thereof.

38. The method of claim 37 wherein the thermosetting resin comprises a phenolic resin.

39. The method of claim 33 wherein the composition further comprises an optional additive selected from the group of a filler, a fiber-containing material, an antistatic agent, a lubricant, a wetting agent, a surfactant, a pigment, a dye, a coupling agent, a plasticizer, a release agent, a suspending agent, a curing agent, and a compatible mixture thereof.

40. The method of claim 33 further comprising the steps of:

applying an intermediate binder precursor over the at least partially cured first resin precursor and the plurality of abrasive particles; and at least partially curing the intermediate binder precursor prior to applying the composition formed by blending a thermosetting resin and a polymeric additive.

41. The method of claim 40 wherein the intermediate binder precursor is selected from the group of a phenolic resin, an aminoplast resin having pendant α,β-unsaturated carbonyl groups, a urethane resin, an epoxy resin, a urea-formaldehyde resin, an isocyanurate resin, a melamine-formaldehyde resin, an acrylate resin, an acrylated isocyanurate resin, an acrylated urethane resin, an acrylated epoxy resin, a bismaleimide resin, and a mixture thereof.

42. The method of claim 41 wherein the intermediate binder precursor comprises a phenolic resin binder precursor.

43. A method of reducing a surface of a workpiece comprising the steps of:

frictionally engaging a peripheral surface of an abrasive article with a surface of a workpiece, wherein the abrasive article comprises:

a backing having a first major surface and a second major surface;

a plurality of abrasive particles; at least one binder system formed from a composition comprising a thermosetting resin and a polymeric additive comprising a polymeric backbone component having substituents attached thereto, wherein the substituents comprise:

at least one urethane linked nitrogen-bonded hydrocarbon side chain having about 5 carbon atoms or more in length and a terminal methyl group; and at least one oxygen linked water solubilizing group, wherein the binder system adheres the plurality of abrasive particles to the first major surface of the backing; and moving the abrasive article and the workpiece relative to each other such that the surface of the workpiece is reduced.

44. A method of using an abrasive article to reduce a surface of a workpiece comprising the steps of:

frictionally engaging a peripheral surface of an abrasive article with a surface of a workpiece, wherein the abrasive article comprises:

a backing having a first major surface and a second major surface;

a plurality of abrasive particles;

a make coat binder system formed from a first binder precursor, wherein the make coat binder system bonds the plurality of abrasive particles to the first major surface of the backing; and a size coat binder system present over the abrasive particles on at least a portion of the plurality of the abrasive particles forming at least a portion of the peripheral surface, wherein the size coat binder system is formed from a composition comprising a thermosetting resin and an ethylene-containing backbone having at least one pendant urethane linked nitrogen-bonded hydrocarbon side chain having about 5 carbon atoms or more in length and a terminal methyl group; and at least one pendant oxygen linked water solubilizing group; and moving the abrasive article and the workpiece relative to each other such that the surface of the workpiece is reduced.

45. A method of using an abrasive article to reduce a surface of a workpiece comprising the steps of:

frictionally engaging a peripheral surface an abrasive article with a surface of a workpiece, wherein the abrasive article comprises:

a backing having a first major surface and a second major surface;

a plurality of abrasive particles;

a make coat binder system formed from a first binder precursor, wherein the make coat binder system bonds the plurality of abrasive particles to the first major surface of the backing;

a size coat binder system present over the abrasive particles on at least a portion of the plurality of the abrasive particles forming at least a portion of the peripheral surface, wherein the size coat binder system is formed from a composition comprising a thermosetting resin and a polymeric additive comprising an ethylene-containing backbone having substituents attached thereto, wherein the substituents comprise:

at least one urethane linked nitrogen-bonded hydrocarbon side chain having about 5 carbon atoms or more in length and a terminal methyl group; and at least one oxygen linked water solubilizing group; and moving the abrasive article and the workpiece relative to each other such that the surface of the workpiece is reduced.

46. A method of using an abrasive article to reduce a surface of a workpiece comprising the steps of:

frictionally engaging a peripheral surface of a peripheral surface of an abrasive article with a surface of a workpiece, wherein the abrasive article comprises:

a backing having a first major surface and a second major surface;

a plurality of abrasive particles;

a make coat binder system formed from a first binder precursor, wherein the make coat binder system bonds the plurality of abrasive particles to the first major surface of the backing;

a peripheral coat binder system present over the abrasive particles on at least a portion of the plurality of the abrasive particles forming at least a portion of the peripheral surface, wherein the peripheral coat binder system is formed from a composition comprising:

a thermosetting resin comprising a phenolic resin; and a polymeric additive comprising a polymeric backbone component having at least one pendent urethane-linked hydrocarbon:

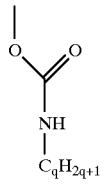

wherein q is 5 or more; and at least one pendant oxygen linked water solubilizing group:

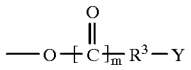

wherein each $R^3$ is independently a divalent organic linking group; m is 0 or 1; and each Y moiety independently comprises a functionality capable of being ionized or is the ionized form thereof; and moving the abrasive article and the workpiece relative to each other such that the surface of the workpiece is reduced.

* * * * *

UNITED STATES PATENT AND TRADEMARK OFFICE

CERTIFICATE OF CORRECTION

PATENT NO. : 5,914,299
DATED : June 22, 1999
INVENTOR(S) : Walter L. Harmer, James P. Dizio, and Alan R. Kirk It is certified that error appears in the above-identified patent and that said Letters Patent is hereby corrected as shown below:

Title page,
Under U.S. PATENT DOCUMENTS, please insert:

| | | |
|---|---|---|
| -- 4,241,198 | 12/1980 | Kobayashi |
| 4,299,741 | 11/1981 | Doehnert |
| 4,342,815 | 08/1982 | Doehnert |
| 4,973,513 | 11/1990 | Riedel |
| 5,032,460 | 07/1991 | Kantner et al. |
| 5,089,336 | 02/1992 | Kumar et al. |
| 5,202,190 | 04/1993 | Kantner et al. |
| 5,225,480 | 07/1993 | Tseng et al. |
| 5,350,631 | 09/1994 | Tseng et al. |
| 5,356,706 | 10/1994 | Shores |
| 5,516,865 | 05/1996 | Urquiola |
| 5,578,097 | 11/1996 | Gaeta et al. |
| 5,667,542 | 09/1997 | Law et al. |

FOREIGN PATENT DOCUMENTS, please insert;

| | | |
|---|---|---|
| 06192341-A | 7/1994 | Japan |
| 03086779-A | 4/1991 | Japan |
| 03086778-A | 4/1991 | Japan |
| 03086777-A | 4/1991 | Japan |
| 03086776-A | 4/1991 | Japan |
| 61126191-A | 6/1986 | Japan |
| 57061061-A | 4/1982 | Japan |

Column 1,
Line 50, "On" should read -- One --.

Column 2,
Line 64, "thereof" should read -- thereof. --.

Column 8,
Line 42, "thereof" should read -- thereof. --.

Column 12,
Line 7, "thereof" should read -- thereof. --.

UNITED STATES PATENT AND TRADEMARK OFFICE

CERTIFICATE OF CORRECTION

PATENT NO. : 5,914,299
DATED : June 22, 1999
INVENTOR(S) : Walter L. Harmer, James P. Dizio, and Alan R. Kirk It is certified that error appears in the above-identified patent and that said Letters Patent is hereby corrected as shown below:

Column 13,
Line 28, "gunder" should read -- under --.

Column 23,
Line 5, "having having" should read -- having --.

Column 34,
Lines 46 and 47, delete "of a peripheral surface".

Signed and Sealed this

Twenty-fifth Day of December, 2001

*Attest:*

*Attesting Officer*

JAMES E. ROGAN
*Director of the United States Patent and Trademark Office*